US011371443B2

(12) United States Patent
Kato et al.

(10) Patent No.: US 11,371,443 B2
(45) **Date of Patent: *Jun. 28, 2022**

(54) CONTROL SYSTEM FOR INTERNAL COMBUSTION ENGINE, AND INTERNAL COMBUSTION ENGINE

(71) Applicant: TOYOTA JIDOSHA KABUSHIKI KAISHA, Toyota (JP)

(72) Inventors: Daiki Kato, Toyota (JP); Ryusuke Kuroda, Nagoya (JP); Masanao Idogawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/841,999

(22) Filed: Apr. 7, 2020

(65) Prior Publication Data

US 2020/0325833 A1 Oct. 15, 2020

(30) Foreign Application Priority Data

Apr. 10, 2019 (JP) ..... JP2019-074835

(51) Int. Cl.
*F02D 41/06* (2006.01)
*F02D 1/00* (2006.01)
(Continued)

(52) U.S. Cl.
CPC ..... *F02D 1/00* (2013.01); *F02D 41/009* (2013.01); *F02D 41/1405* (2013.01);
(Continued)

(58) Field of Classification Search
CPC ..... F02D 1/00; F02D 41/009; F02D 41/1405; F02M 59/10; F02M 59/20; F02M 61/14
See application file for complete search history.

(56) References Cited

U.S. PATENT DOCUMENTS 5,513,609 A 5/1996 Hirose et al.
9,327,706 B2 * 5/2016 Reed ..... B60K 6/48
(Continued)

FOREIGN PATENT DOCUMENTS

EP 2 169 203 A1 3/2010
JP S 60-240875 11/1985
(Continued)

OTHER PUBLICATIONS

Office Action issued in U.S. Appl. No. 16/839,330 dated Jul. 30, 2021.
(Continued)

*Primary Examiner* — Gonzalo Laguarda

(74) *Attorney, Agent, or Firm* — Finnegan, Henderson, Farabow, Garrett & Dunner, LLP

(57) ABSTRACT

A control system includes a controller. The controller counts the number of driving times of the high pressure fuel pump, which is the number of the reciprocating motions of the plunger based on a crank counter that is counted up at every predetermined crank angle. The controller stores a map in which a top dead center of the plunger is associated with a crank counter value, and store a crank counter value while an engine is stopped as a stop-time counter value. The controller calculates, referring to the map, the number of the crank counter values corresponding to the top dead center of the plunger between a crank counter value and the stop-time counter value, and set a calculated number as the number of driving times.

5 Claims, 11 Drawing Sheets

(51) Int. Cl.

| | |
|---|---|
| ***F02D 41/00*** | (2006.01) |
| ***F02M 59/10*** | (2006.01) |
| ***F02M 59/20*** | (2006.01) |
| ***F02M 61/14*** | (2006.01) |
| ***F02D 41/14*** | (2006.01) |

(52) U.S. Cl.
CPC ..... *F02M 59/10* (2013.01); *F02M 59/20* (2013.01); *F02M 61/14* (2013.01); *F02D 41/062* (2013.01)

(56) References Cited

U.S. PATENT DOCUMENTS

| | | | | |
|---|---|---|---|---|
| 9,702,326 | B2 * | 7/2017 | Roettger | F02D 33/006 |
| 10,012,171 | B2 * | 7/2018 | Shibata | F02N 11/08 |
| 10,309,335 | B2 | 6/2019 | Klesse et al. | |
| 2008/0314364 | A1 | 12/2008 | Okamoto | |
| 2009/0082939 | A1 | 3/2009 | Iihoshi et al. | |
| 2009/0308351 | A1 | 12/2009 | Okamoto | |
| 2010/0268441 | A1 | 10/2010 | Yoshiume | |
| 2011/0118078 | A1 | 5/2011 | Kraska et al. | |
| 2011/0162622 | A1 | 7/2011 | Kojima et al. | |
| 2012/0065868 | A1 | 3/2012 | Ando | |
| 2017/0089291 | A1 | 3/2017 | Suzuki | |
| 2017/0342935 | A1 | 11/2017 | Arihara et al. | |
| 2019/0153974 | A1 | 5/2019 | Mukaihara et al. | |
| 2020/0325832 | A1 * | 10/2020 | Kato | F02D 41/062 |

FOREIGN PATENT DOCUMENTS

| | | |
|---|---|---|
| JP | 11-107823 | 4/1999 |
| JP | 11-270385 | 10/1999 |
| JP | 2000-303887 A | 10/2000 |
| JP | 2008-019874 | 1/2008 |
| JP | 2010-090901 | 4/2010 |
| JP | 2015-059469 | 3/2015 |

OTHER PUBLICATIONS

U.S. Appl. No. 16/839,330, filed Apr. 3, 2020.

Final Office Action issued in U.S. Appl. No. 16/839,330 dated Nov. 19, 2021.

Advisory Action issued in U.S. Appl. No. 16/839,330 dated Feb. 4, 2022.

Notice of Allowance issued in U.S. Appl. No. 16/839,330 dated Mar. 23, 2022.

* cited by examiner

CONTROL SYSTEM FOR INTERNAL COMBUSTION ENGINE, AND INTERNAL COMBUSTION ENGINE

CROSS-REFERENCE TO RELATED APPLICATION

This application claims priority to Japanese Patent Application No. 2019-074835 filed on Apr. 10, 2019, incorporated herein by reference in its entirety.

BACKGROUND

1. Technical Field

The disclosure relates to a control system for an internal combustion engine that controls the internal combustion engine including a high pressure fuel pump, and the internal combustion engine.

2. Description of Related Art

Japanese Unexamined Patent Application Publication No. 11-270385 (JP 11-270385 A) discloses a controller for an internal combustion engine that prohibits an in-cylinder fuel injection until a pressure of a fuel supplied to an in-cylinder fuel injection valve increases when the internal combustion engine is started. Specifically, JP 11-270385 A describes that the controller for the internal combustion engine prohibits the in-cylinder fuel injection valve from injecting the fuel until the number of rotation times of a crankshaft reaches the predetermined number of times. A high pressure fuel pump that supplies a high pressure fuel to the in-cylinder fuel injection valve is driven by a pump cam provided on a camshaft that rotates in conjunction with a crankshaft. Therefore, in a case where the number of rotation times of the crankshaft reaches the predetermined number of times, it can be estimated that the high pressure fuel pump is sufficiently driven and the pressure of the fuel supplied to the in-cylinder fuel injection valve is high.

Japanese Unexamined Patent Application Publication No. 2015-59469 (JP 2015-59469 A) describes the controller for the internal combustion engine generating a crank counter that is counted up at every predetermined crank angle.

SUMMARY

Meanwhile, the pump cam for driving the high pressure fuel pump may be provided with a plurality of cam peaks such that the high pressure fuel pump is driven a plurality of times while the crankshaft makes one rotation. By counting up at every predetermined crank angle, and checking the crank counter that changes according to a change in the crank angle while the crankshaft makes one rotation, the number of driving times of the high pressure fuel pump can be counted more accurately than counting the number of driving times of the high pressure fuel pump according to the number of rotation times of the crankshaft.

However, the crank counter starts counting up after the crank angle is identified, for example, a signal corresponding to missing teeth indicating the arrival of a specific crank angle is output by a crank position sensor. Therefore, the number of driving times of the high pressure fuel pump cannot be counted until the crank angle is identified.

A first aspect of the disclosure relates to a control system for an internal combustion engine including a high pressure fuel pump and an in-cylinder fuel injection valve. The high pressure fuel pump is configured such that a volume of a fuel chamber is increased and is decreased and a fuel is pressurized by a reciprocating motion of a plunger due to an action of a pump cam that rotates in conjunction with a rotation of a crankshaft. The in-cylinder fuel injection valve is configured to inject the fuel into a cylinder. The control system includes a controller. The controller is configured to count the number of driving times of the high pressure fuel pump, which is the number of the reciprocating motions of the plunger based on a crank counter that is counted up at every predetermined crank angle. The controller is configured to store a map in which a top dead center of the plunger is associated with a crank counter value, and store the crank counter value while an engine is stopped as a stop-time counter value. Referring to the map, the controller is configured to calculate the number of the crank counter values corresponding to the top dead center of the plunger between a crank counter value when the crank angle is identified after starting the engine and the stop-time counter value, and set the calculated number as the number of driving times from the start of the engine until the crank angle is identified.

If the crank counter value when the stop-time counter value and the crank angle are identified is known, a change in the crank angle from a state where the internal combustion engine is stopped until the crank angle is identified by driving the crankshaft in accordance with the start of the engine is known. Therefore, as in the above configuration, the number of driving times of the high pressure fuel pump during the period can be calculated by referring to the map that associates the top dead center of the plunger with the crank counter value.

That is, with the above configuration, the number of driving times of the high pressure fuel pump from the start of the engine until the crank angle is identified can be counted. In the control system according to the first aspect, the controller may be configured to acquire a high pressure system fuel pressure detected by fuel pressure sensor that detects a high pressure system fuel pressure which is a pressure of the fuel supplied to the in-cylinder fuel injection valve, and the controller may be configured to, when the stop-time counter value is not stored, calculate the number of driving times from the start of engine until the crank angle is identified by increasing the number of driving times by one each time the high pressure system fuel pressure increases by a threshold or more.

When the fuel is discharged from the high pressure fuel pump by a reciprocating motion of the plunger, the high pressure system fuel pressure increases. Therefore, when an increase width of the high pressure system fuel pressure becomes large enough to estimate the discharge of the fuel from the high pressure fuel pump, it can be estimated that the plunger has reciprocated once. Therefore, with the above configuration, even when the stop-time counter value is not stored in the controller, the number of driving times of the high pressure fuel pump from the start of the engine can be counted based on the high pressure system fuel pressure.

In the control system according to the first aspect, the controller may be configured to calculate the number of driving times of the high pressure fuel pump after the crank angle is identified with reference to the map based on the crank counter value, and update the number of driving times by integrating the calculated number of driving times into the number of driving times from the start of the engine until the crank angle is identified.

By referring to the map that associates the top dead center of the plunger with the crank counter value, a timing when the plunger reaches the top dead center can be grasped based on the crank counter value. Therefore, the number of driving times after the crank angle is identified can be counted based on the crank counter value by referring to the above described map.

Accordingly, with the above configuration, the number of driving times of the high pressure fuel pump from the start of engine can be calculated. In the control system according to the first aspect, the controller may be configured to cause the in-cylinder fuel injection valve to start to inject the fuel when the calculated number of driving times is equal to or more than a specified number of times.

While the engine is started, the high pressure system fuel pressure which is the pressure of the fuel supplied to the in-cylinder fuel injection valve may be low. In order to perform appropriate fuel injection from the in-cylinder fuel injection valve, the high pressure system fuel pressure needs to be increased to some extent.

With the above configuration, since the fuel injection of the in-cylinder fuel injection valve is started when the calculated number of driving times is equal to or more than the specified number of times and the high pressure system fuel pressure is high, it is possible to suppress an in-cylinder fuel injection from being performed in a state where the high pressure system fuel pressure is low.

In the control system according to the first aspect, the controller may be configured to estimate a high pressure system fuel pressure which is a pressure of the fuel supplied to the in-cylinder fuel injection valve based on the calculated number of driving times. The fact that the number of driving times of the high pressure fuel pump is large means that the amount of the fuel delivered from the high pressure fuel pump is large, and thus, the number of driving times of the high pressure fuel pump is correlated with the high pressure system fuel pressure. Accordingly, as in the above configuration, the high pressure system fuel pressure can be estimated based on the calculated number of driving times. With such a configuration, for example, even when a sensor that detects the high pressure system fuel pressure has an abnormality, a control based on an estimated high pressure system fuel pressure can be performed.

In the control system according to the first aspect, the controller may be configured to cause the in-cylinder fuel injection valve to start to inject the fuel when the high pressure system fuel pressure estimated based on the calculated number of driving times is equal to or more than a specified pressure.

With the above configuration, the fuel injection of the in-cylinder fuel injection valve is started when it is estimated that the high pressure system fuel pressure estimated based on the calculated number of driving times is equal to or more than the specified pressure and the high pressure system fuel pressure is high. Therefore, it is possible to suppress in-cylinder fuel injection from being performed in the state where the high pressure system fuel pressure is low.

A second aspect of the disclosure relates to an internal combustion engine. The internal combustion engine includes a high pressure fuel pump, an in-cylinder fuel injection valve, and a controller. The high pressure fuel pump is configured such that a volume of a fuel chamber is increased and is decreased and a fuel is pressurized by a reciprocating motion of a plunger due to an action of a pump cam that rotates in conjunction with a rotation of a crankshaft. The in-cylinder fuel injection valve is configured to inject the fuel into a cylinder. The controller is configured to count the number of driving times of the high pressure fuel pump, which is the number of the reciprocating motions of the plunger based on a crank counter that is counted up at every predetermined crank angle. The controller is configured to store a map in which a top dead center of the plunger is associated with a crank counter value, and store the crank counter value while an engine is stopped as a stop-time counter value. Referring to the map, the controller is configured to calculate the number of the crank counter values corresponding to the top dead center of the plunger between a crank counter value when the crank angle is identified after starting the engine and the stop-time counter value, and set the calculated number as the number of driving times from the start of the engine until the crank angle is identified. According to the second aspect, the same effect as in the first aspect can be obtained.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
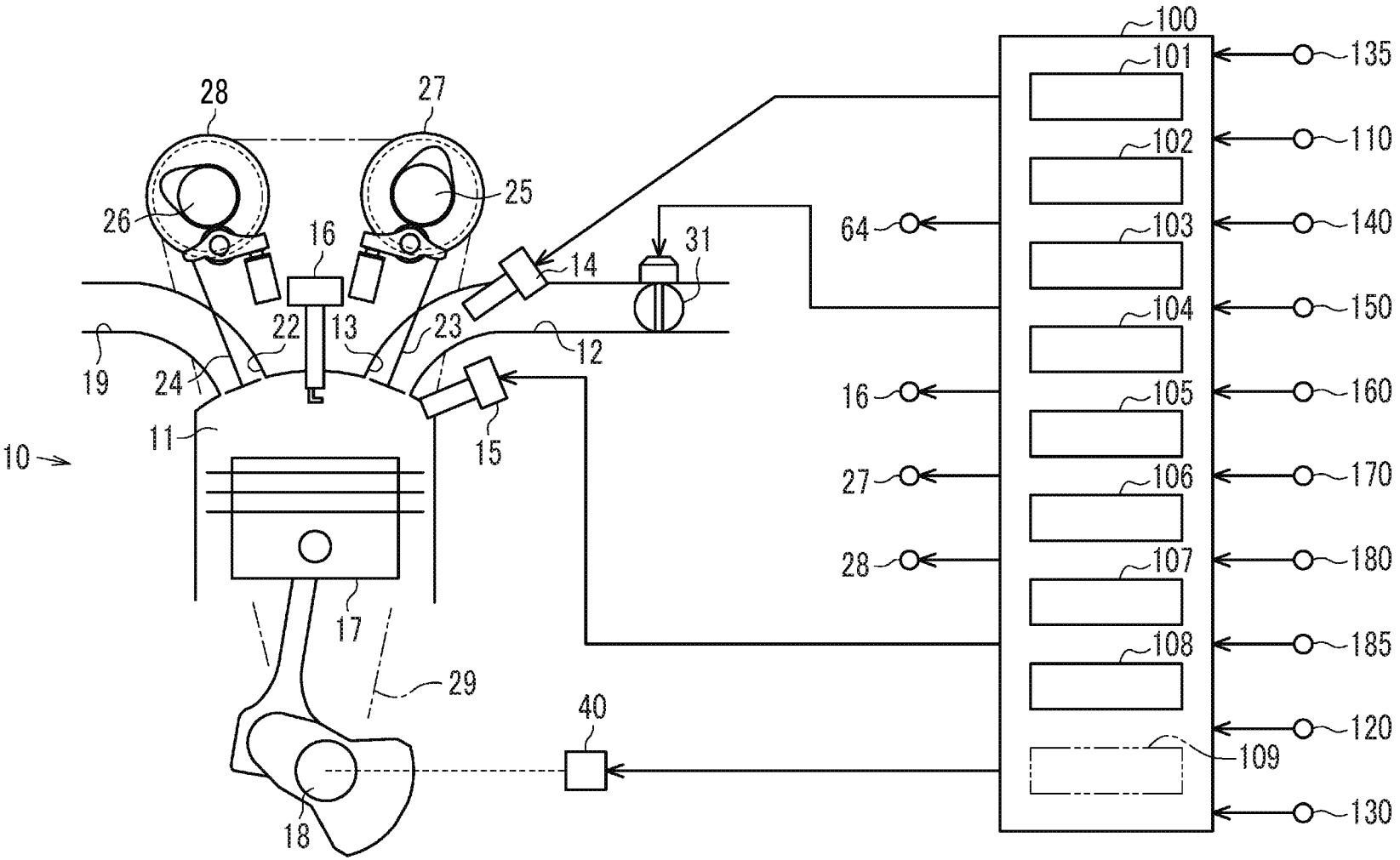
FIG. 1 is a schematic view showing configurations of a controller of an internal combustion engine, and an in-vehicle internal combustion engine that is controlled by the controller.

Hereinafter, an embodiment of a control system for an internal combustion engine will be described with reference to FIGS. 1 to 14. The control system includes a controller 100. As shown in FIG. 1, an intake port 13 of an internal combustion engine 10 controlled by the controller 100 is provided with a port injection valve 14 for injecting a fuel during an intake flowing in the intake port 13. The intake port 13 is connected to an intake passage 12. The intake passage 12 is provided with a throttle valve 31.

Additionally, a combustion chamber 11 is provided with an in-cylinder fuel injection valve 15 for directly injecting the fuel into the combustion chamber 11 and an ignition device 16 for igniting an air-fuel mixture of the air and the fuel introduced into the combustion chamber 11 by a spark discharge. An exhaust passage 19 is connected to the combustion chamber 11 via an exhaust port 22.

The internal combustion engine 10 is an in-vehicle internal combustion engine having in-line four cylinders and includes four combustion chambers 11. However, one of the combustion chambers is shown in FIG. 1. When the air-fuel mixture combusts in the combustion chamber 11, a piston 17 reciprocates, and a crankshaft 18 which is an output shaft of the internal combustion engine 10 rotates. Then, an exhaust after combustion is discharged from the combustion chamber 11 to the exhaust passage 19.

The intake port 13 is provided with an intake valve 23. The exhaust port 22 is provided with an exhaust valve 24. The intake valve 23 and the exhaust valve 24 open and close with a rotation of an intake camshaft 25 and an exhaust camshaft 26 to which the rotation of the crankshaft 18 is transmitted.

The intake camshaft 25 is provided with an intake-side variable valve timing mechanism 27 that changes opening/closing timing of the intake valve 23 by changing a relative rotation phase of the intake camshaft 25 with respect to the crankshaft 18. Further, the exhaust camshaft 26 is provided with an exhaust-side variable valve timing mechanism 28 that changes opening/closing timing of the exhaust valve 24 by changing a relative rotation phase of the exhaust camshaft 26 with respect to the crankshaft 18.

A timing chain 29 is wound around the intake-side variable valve timing mechanism 27, the exhaust-side variable valve timing mechanism 28, and the crankshaft 18. As a result, when the crankshaft 18 rotates, the rotation is transmitted via the timing chain 29, and the intake camshaft 25 rotates with the intake-side variable valve timing mechanism 27. In addition, the exhaust camshaft 26 rotates with the exhaust-side variable valve timing mechanism 28.

The internal combustion engine 10 is provided with a starter motor 40, and while the engine is started, the crankshaft 18 is driven by the starter motor 40 to perform a cranking. Next, a fuel supply system of the internal combustion engine 10 will be described with reference to FIG. 2.

Figure 2:
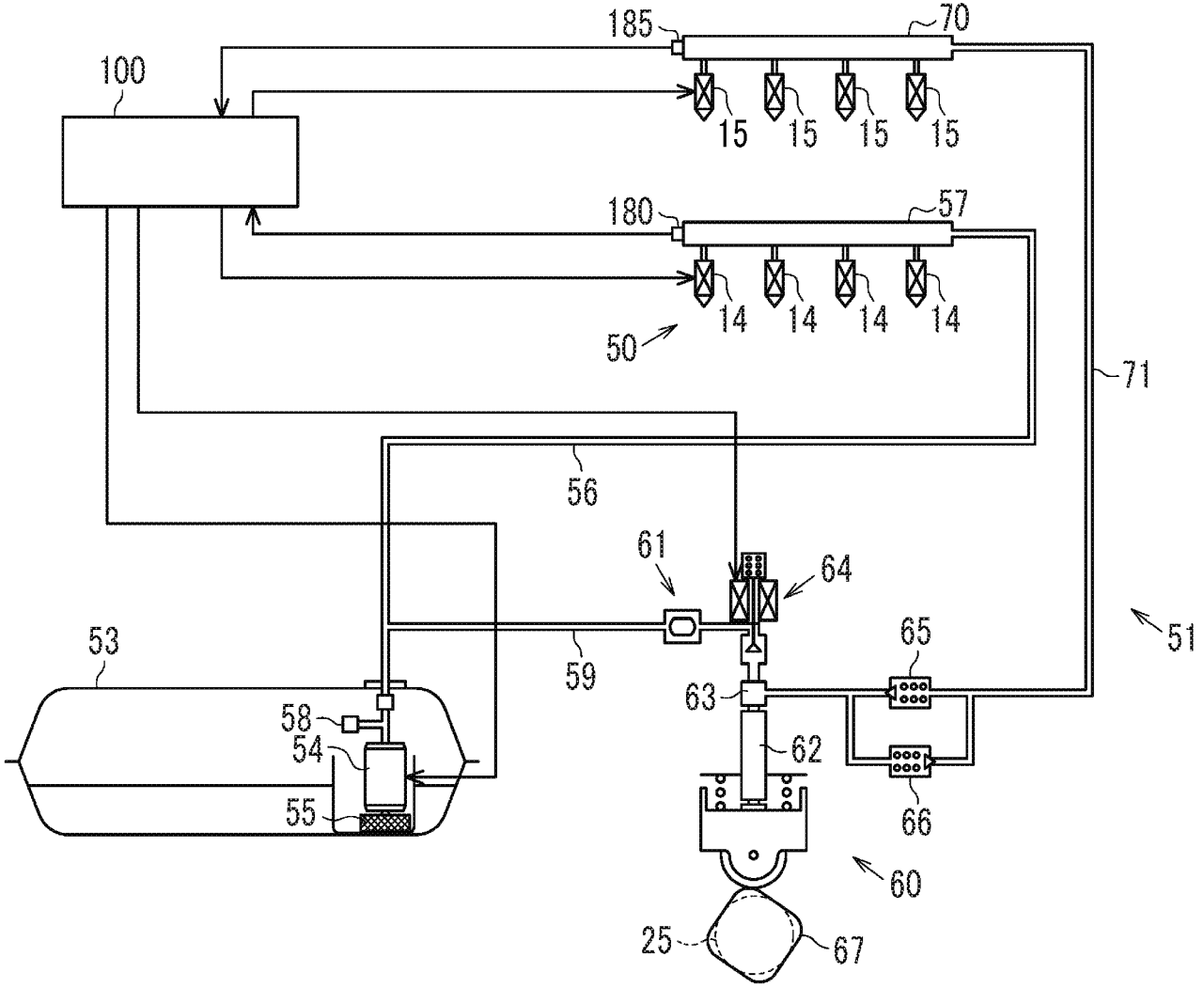
FIG. 2 is a schematic view showing a configuration of a fuel supply system of the internal combustion engine.

As shown in FIG. 2, the internal combustion engine 10 is provided with two system fuel supply systems, a low pressure-side fuel supply system 50 for supplying the fuel to the port injection valve 14 and a high pressure-side fuel supply system 51 for supplying the fuel to the in-cylinder fuel injection valve 15.

A fuel tank 53 is provided with an electric feed pump 54. The electric feed pump 54 pumps up a fuel stored in the fuel tank 53 via a filter 55 that filters impurities in the fuel. Then, the electric feed pump 54 supplies the pumped fuel to a low pressure-side delivery pipe 57 to which the port injection valve 14 of each cylinder is connected through a low pressure fuel passage 56. The low pressure-side delivery pipe 57 is provided with a low pressure system fuel pressure sensor 180 that detects the pressure of the fuel stored inside, that is, a low pressure system fuel pressure PL that is the pressure of the fuel supplied to each port injection valve 14.

In addition, the low pressure fuel passage 56 in the fuel tank 53 is provided with a pressure regulator 58. The pressure regulator 58 opens the valve when the pressure of the fuel in the low pressure fuel passage 56 exceeds a specified regulator set pressure to discharge the fuel in the low pressure fuel passage 56 into the fuel tank 53. As a result, the pressure regulator 58 keeps the pressure of the fuel supplied to the port injection valve 14 at the regulator set pressure or less.

On the other hand, the high pressure-side fuel supply system 51 includes a mechanical high pressure fuel pump 60. The low pressure fuel passage 56 branches halfway and is connected to the high pressure fuel pump 60. The high pressure fuel pump 60 is connected via a connection passage 71 to a high pressure-side delivery pipe 70 to which the in-cylinder fuel injection valve 15 of each cylinder is connected. The high pressure fuel pump 60 is driven by the power of the internal combustion engine 10 to pressurize the fuel sucked from the low pressure fuel passage 56 and send the fuel to the high pressure-side delivery pipe 70 by pressure.

The high pressure fuel pump 60 includes a pulsation damper 61, a plunger 62, a fuel chamber 63, a solenoid spill valve 64, a check valve 65, and a relief valve 66. The plunger 62 is reciprocated by a pump cam 67 provided on the intake camshaft 25, and changes the volume of the fuel chamber 63 according to the reciprocating motion. The solenoid spill valve 64 shields the flow of the fuel between the fuel chamber 63 and the low pressure fuel passage 56 by closing the valve in accordance with energization, and allows the flow of the fuel between the fuel chamber 63 and the low pressure fuel passage 56 by opening the valve in accordance with the stop of energization. The check valve 65 allows the fuel to be discharged from the fuel chamber 63 to the high pressure-side delivery pipe 70, but the check valve 65 prohibits the fuel from flowing backward from the high pressure-side delivery pipe 70 to the fuel chamber 63. The relief valve 66 is provided in a passage that bypasses the check valve 65, and opens the valve when the pressure on the high pressure-side delivery pipe 70 becomes excessively high to allow the fuel to flow backward to the fuel chamber 63.

When the plunger 62 moves in the direction of expanding the volume of the fuel chamber 63, the high pressure fuel pump 60 opens the solenoid spill valve 64 such that the fuel in the low pressure fuel passage 56 is sucked to the fuel chamber 63. When the plunger 62 moves in the direction of reducing the volume of the fuel chamber 63, the high pressure fuel pump 60 closes the solenoid spill valve 64 such that the fuel sucked to the fuel chamber 63 is pressurized and discharged to the high pressure-side delivery pipe 70. Hereinafter, the movement of the plunger 62 in the direction of expanding the volume of the fuel chamber 63 is referred to as a drop of the plunger 62, and the movement of the plunger 62 in the direction of reducing the volume of the fuel chamber 63 is referred to as a rise of the plunger 62. In the internal combustion engine 10, an amount of the fuel discharged from the high pressure fuel pump 60 is adjusted by changing a ratio of the period in which the solenoid spill valve 64 is closed during the period in which the plunger 62 rises.

Among the low pressure fuel passages 56, a branch passage 59 that is branched and connected to the high pressure fuel pump 60 is connected to a pulsation damper 61 that reduces pressure pulsation of the fuel with the operation of the high pressure fuel pump 60. The pulsation damper 61 is connected to the fuel chamber 63 via the solenoid spill valve 64.

The high pressure-side delivery pipe 70 is provided with a high pressure system fuel pressure sensor 185 that detects the pressure of the fuel in the high pressure-side delivery pipe 70, that is, the high pressure system fuel pressure PH that is the pressure of the fuel supplied to the in-cylinder fuel injection valve 15.

The controller 100 controls the internal combustion engine 10 as a control target by operating various operation target devices such as the throttle valve 31, the port injection valve 14, the in-cylinder fuel injection valve 15, the ignition device 16, the intake-side variable valve timing mechanism 27, the exhaust-side variable valve timing mechanism 28, the solenoid spill valve 64 of the high pressure fuel pump 60, and the starter motor 40.

As shown in FIG. 1, a detection signal of a driver's accelerator operation amount by an accelerator position sensor 110 and a detection signal of a vehicle speed which is a traveling speed of the vehicle by a vehicle speed sensor 140 are input into the controller 100.

Further, detection signals of various other sensors are input into the controller 100. For example, an air flow meter 120 detects a temperature of air sucked to the combustion chamber 11 through the intake passage 12 and an intake air amount which is the mass of the air sucked. A coolant temperature sensor 130 detects a coolant temperature THW, which is a temperature of a coolant of the internal combustion engine 10. A fuel temperature sensor 135 detects a fuel temperature TF that is a temperature of the fuel in the high pressure-side delivery pipe 70.

A crank position sensor 150 outputs the crank angle signal according to a change in a rotation phase of the crankshaft 18. Further, an intake side cam position sensor 160 outputs an intake-side cam angle signal according to a change in the rotation phase of the intake camshaft 25 of the internal combustion engine 10. The exhaust-side cam position sensor 170 outputs an exhaust-side cam angle signal according to a change in the rotation phase of the exhaust camshaft 26 of the internal combustion engine 10.

As shown in FIG. 1, the controller 100 includes an acquisition unit 101 acquiring signals output from various sensors and various calculation results, and a storage unit 102 storing calculation programs, calculation maps, and various data.

The controller 100 takes in output signals of the various sensors, performs various calculations based on the output signals, and executes various controls related to engine operation according to the calculation results. The controller 100 includes an injection control unit 104 controlling the port injection valve 14 and the in-cylinder fuel injection valve 15, an ignition control unit 105 controlling the ignition device 16, and a valve timing control unit 106 controlling the intake-side variable valve timing mechanism 27 and the exhaust-side variable valve timing mechanism 28 as control units that perform such various controls.

Further, the controller 100 includes a crank counter calculation unit 103 that calculates the crank counter indicating the crank angle which is the rotation phase of the crankshaft 18 based on the crank angle signal, the intake-side cam angle signal, and the exhaust-side cam angle signal. The injection control unit 104, the ignition control unit 105, and the valve timing control unit 106 control the fuel injection and ignition timing for each cylinder with reference to the crank counter calculated by the crank counter calculation unit 103, and control the intake-side variable valve timing mechanism 27 and the exhaust-side variable valve timing mechanism 28.

Specifically, the injection control unit 104 calculates a target fuel injection amount which is a control target value for fuel injection amount based on an accelerator operation amount, a vehicle speed, an intake air amount, an engine rotation speed, an engine load factor, and the like. The engine load factor is a ratio of inflow air amount per combustion cycle of one cylinder to reference inflow air amount. Here, the reference inflow air amount is an inflow air amount per combustion cycle of one cylinder when the opening degree of the throttle valve 31 is maximized, and is determined according to the engine rotation speed. The injection control unit 104 basically calculates the target fuel injection amount such that an air-fuel ratio becomes a stoichiometric air-fuel ratio. Then, control target values for injection timing and fuel injection time in the port injection valve 14 and the in-cylinder fuel injection valve 15 are calculated. The port injection valve 14 and the in-cylinder fuel injection valve 15 are driven to open the valve according to the control target values. As a result, an amount of fuel corresponding to an operation state of the internal combustion engine 10 is injected and supplied to the combustion chamber 11. In the internal combustion engine 10, which injection valve injects the fuel is switched according to the operation state. Therefore, in the internal combustion engine 10, other than when the fuel is injected from both the port injection valve 14 and the in-cylinder fuel injection valve 15, there are cases when the fuel is injected solely from the port injection valve 14 and when the fuel is injected solely from the in-cylinder fuel injection valve 15. Further, the injection control unit 104 stops the injection of the fuel and stops the supply of the fuel to the combustion chamber 11 during a deceleration, for example, when the accelerator operation amount is "0", to perform a fuel cut-off control to reduce a fuel consumption.

The ignition control unit 105 calculates an ignition timing which is a timing of a spark discharge by the ignition device 16 to operate the ignition device 16 and ignite the air-fuel mixture. The valve timing control unit 106 calculates a target value of a phase of the intake camshaft 25 with respect to the crankshaft 18 and a target value of a phase of the exhaust camshaft 26 with respect to the crankshaft 18 based on the engine rotation speed and the engine load factor to operate the intake-side variable valve timing mechanism 27 and the exhaust-side variable valve timing mechanism 28. Thus, the valve timing control unit 106 controls the opening/closing timing of the intake valve 23 and the opening/closing timing of the exhaust valve 24. For example, the valve timing control unit 106 controls a valve overlap that is a period where both the exhaust valve 24 and the intake valve 23 are open.

In addition, through the injection control unit 104 and the ignition control unit 105, the controller 100 automatically stops the engine operation by stopping the fuel supply and ignition while the vehicle is stopped, and restarts the engine operation by automatically restarting the fuel supply and ignition at the time at which the vehicle is started. That is, the controller 100 executes a stop & start control for suppressing an idling operation from continuing by automatically stopping and restarting the engine operation.

Further, as shown in FIG. 1, the controller 100 is provided with a starter control unit 107 controlling the starter motor 40. In the controller 100, when the operation is stopped by the stop & start control, the crank counter value while the crankshaft 18 is stopped is stored in the storage unit 102 as a stop-time counter value VCAst.

Next, the crank position sensor 150, the intake side cam position sensor 160, and the exhaust-side cam position sensor 170 will be described in detail, and a method of calculating the crank counter will be described.

Figure 3:
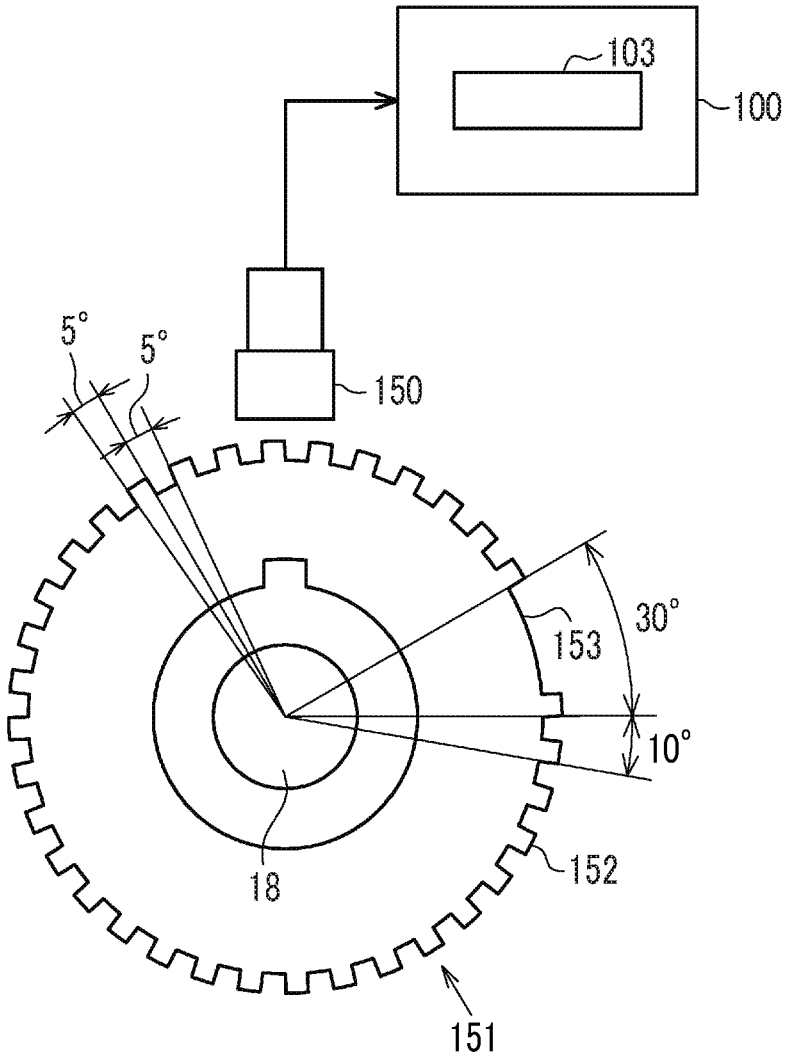
FIG. 3 is a schematic view showing a relationship between a crank position sensor and a sensor plate.

First, the crank position sensor 150 will be described with reference to FIG. 3 and FIG. 4. FIG. 3 shows a relationship between the crank position sensor 150 and the sensor plate 151 attached to the crankshaft 18.

Figure 4:
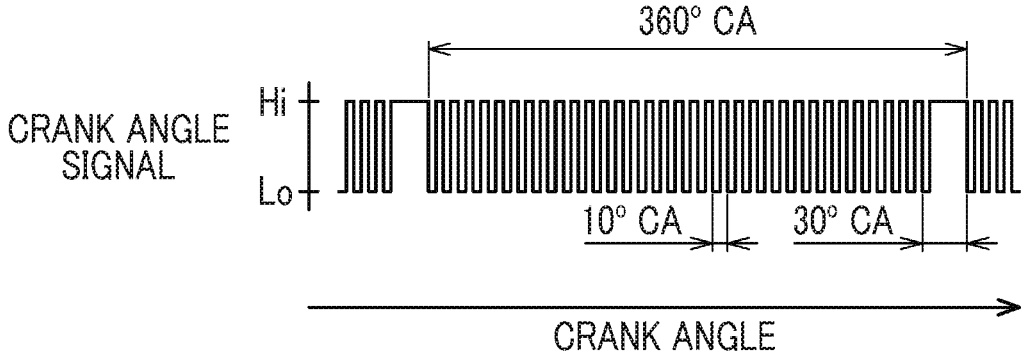
FIG. 4 is a timing chart showing a waveform of a crank angle signal output from the crank position sensor.

A timing chart of FIG. 4 shows the waveform of the crank angle signal output by the crank position sensor 150.

As shown in FIG. 3, the disc-shaped sensor plate 151 is attached to the crankshaft 18. 34 signal teeth 152 having a width of 5° at the angle are arranged side by side at intervals of 5° at a periphery of the sensor plate 151. Therefore, as shown on the right side of FIG. 3, the sensor plate 151 has one missing teeth portion 153 in which the interval between adjacent signal teeth 152 is at the angle of 25° and thus two signal teeth 152 lack as compared with other portions.

As shown in FIG. 3, the crank position sensor 150 is arranged toward the periphery of the sensor plate 151 so as to face the signal teeth 152 of the sensor plate 151. The crank position sensor 150 is a magnetoresistive element type sensor including a sensor circuit with built-in a magnet and a magnetoresistive element. When the sensor plate 151 rotates with the rotation of the crankshaft 18, the signal teeth 152 of the sensor plate 151 and the crank position sensor 150 come closer or away from each other. As a result, a direction of a magnetic field applied to the magnetoresistive element in the crank position sensor 150 changes, and an internal resistance of the magnetoresistive element changes. The sensor circuit compares the magnitude relationship between a waveform obtained by converting the change in the resistance value into a voltage and a threshold, and shapes the waveform into a rectangular wave based on a Lo signal as the first signal and a Hi signal as the second signal, and outputs the rectangular wave as a crank angle signal.

As shown in FIG. 4, specifically, the crank position sensor 150 outputs the Lo signal when the crank position sensor 150 faces the signal teeth 152, and outputs the Hi signal when the crank position sensor 150 faces a gap portion between the signal teeth 152. Therefore, when the Hi signal corresponding to the missing teeth portion 153 is detected, the Lo signal corresponding to the signal teeth 152 is subsequently detected. Then, the Lo signal corresponding to the signal teeth 152 is detected every 10° C.A. After 34 Lo signals are detected in this way, the Hi signal corresponding to the missing teeth portion 153 is detected again. Therefore, a rotation angle until the Lo signal corresponding to the next signal teeth 152 is detected across the Hi signal corresponding to the missing teeth portion 153 is 30° C.A at the crank angle.

As shown in FIG. 4, after the Lo signal corresponding to the signal teeth 152 is detected following the Hi signal corresponding to the missing teeth portion 153, next, an interval until the Lo signal is detected following the Hi signal corresponding to the missing teeth portion 153 is 360° C.A at the crank angle.

The crank counter calculation unit 103 calculates the crank counter by counting edges that change from the Hi signal to the Lo signal. Further, based on the detection of the Hi signal corresponding to the missing teeth portion 153 longer than the other Hi signals, it is detected that the rotation phase of the crankshaft 18 is the rotation phase corresponding to the missing teeth portion 153.

Next, the intake side cam position sensor 160 will be described with reference to FIG. 5. Both of the intake side cam position sensor 160 and the exhaust-side cam position sensor 170 are the magnetoresistive element type sensor similar to the crank position sensor 150. Since the intake side cam position sensor 160 and the exhaust-side cam position sensor 170 differ in the object to be detected, the intake-side cam angle signal detected by the intake side cam position sensor 160 will be described in detail here.

Figure 5:
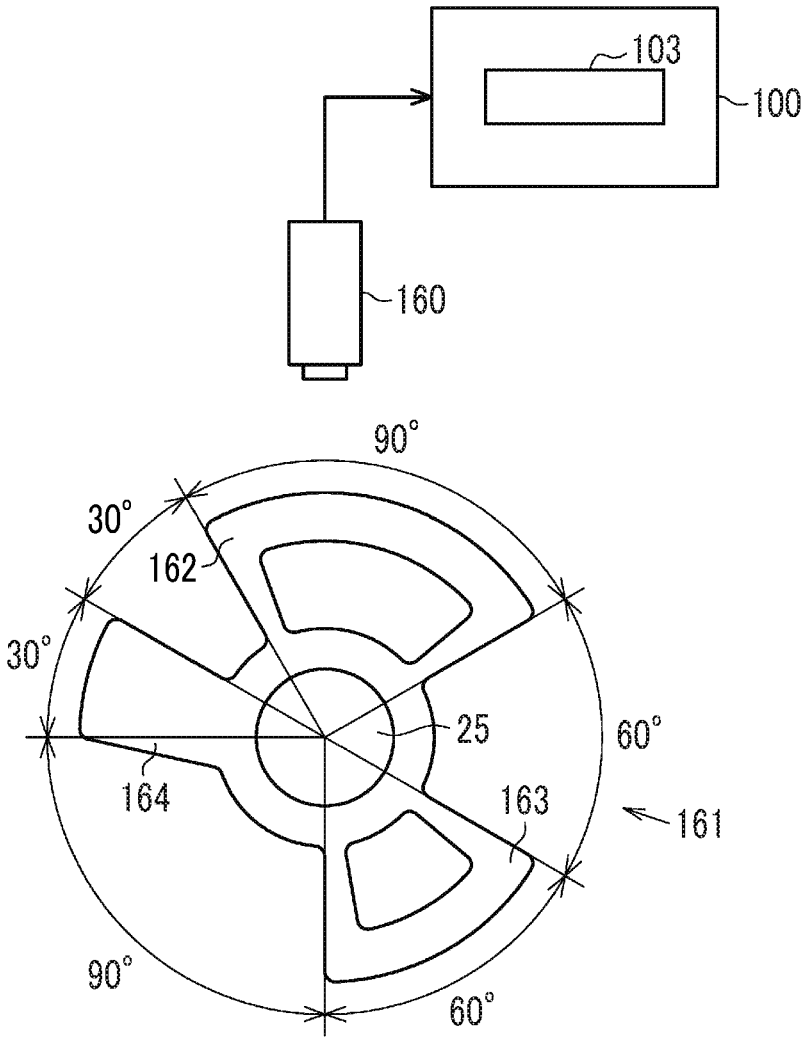
FIG. 5 is a schematic view showing a relationship between an intake side cam position sensor and a timing rotor.
Figure 6:
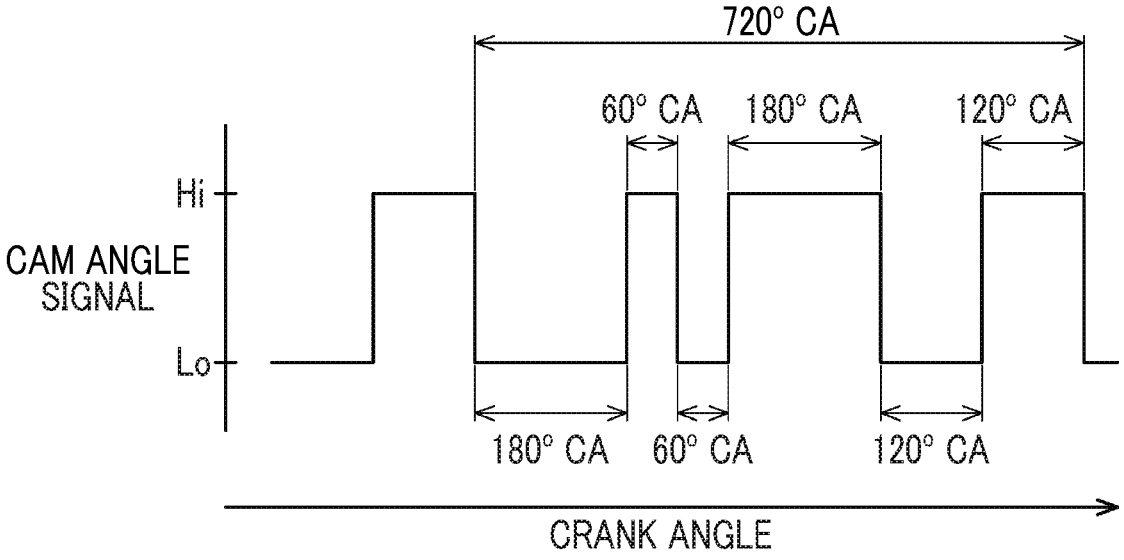
FIG. 6 is a timing chart showing a waveform of an intake-side cam angle signal output from the intake side cam position sensor.

FIG. 5 shows a relationship between the intake side cam position sensor 160 and a timing rotor 161 attached to the intake camshaft 25. A timing chart of FIG. 6 shows the waveform of the intake-side cam angle signal output from the intake side cam position sensor 160.

As shown in FIG. 5, the timing rotor 161 is provided with three protrusions, that is, a large protrusion 162, a middle protrusion 163, and a small protrusion 164, each of which has a different occupation range in the circumferential direction.

The largest large protrusion 162 is formed so as to spread over at the angle of 90° in the circumferential direction of the timing rotor 161. On the other hand, the smallest small protrusion 164 is formed so as to spread over at the angle of 30°, and the middle protrusion 163 smaller than the large protrusion 162 and larger than the small protrusion 164 is formed so as to spread over at the angle of 60°.

As shown in FIG. 5, large protrusion s 162, middle protrusions 163, and small protrusions 164 are arranged in the timing rotor 161 at predetermined intervals. Specifically, the large protrusion 162 and the middle protrusion 163 are arranged at intervals of 60° at the angle, and the middle protrusion 163 and the small protrusion 164 are arranged at intervals of 90° at the angle. The large protrusion 162 and the small protrusion 164 are arranged at intervals of 30° at the angle.

As shown in FIG. 5, the intake side cam position sensor 160 is arranged toward the periphery of the timing rotor 161 so as to face the large protrusion 162, the middle protrusion 163, and the small protrusion 164 of the timing rotor 161. The intake side cam position sensor 160 outputs the Lo signal and the Hi signal as with the crank position sensor 150.

Specifically, as shown in FIG. 6, the intake side cam position sensor 160 outputs the Lo signal when the intake side cam position sensor 160 faces the large protrusion 162, the middle protrusion 163, and the small protrusion 164, and outputs the Hi signal when the intake side cam position sensor 160 faces a gap portion between each protrusion. The intake camshaft 25 rotates once while the crankshaft 18 rotates twice. Therefore, the change of the intake-side cam angle signal repeats a fixed change at a cycle of 720° C.A at the crank angle.

As shown in FIG. 6, after the Lo signal that continues over 180° C.A corresponding to the large protrusion 162 is output, the Hi signal that continues over 60° C.A is output, and then the Lo signal that continues over 60° C.A corresponding to the small protrusion 164 is output. After that, the Hi signal that continues over 180° C.A is output, and subsequently, the Lo signal that continues over 120° C.A corresponding to the middle protrusion 163 is output. In addition, after the Hi signal that continues over 120° C.A is output lastly, the Lo signal that continues over 180° C.A corresponding to the large protrusion 162 is output again.

Therefore, since the intake-side cam angle signal periodically changes in a fixed change pattern, the controller 100 can detect what rotation phase the intake camshaft 25 is in by recognizing the change pattern of the cam angle signal. For example, when the Lo signal is switched to the Hi signal after the Lo signal having the length corresponding to 60° C.A is output, the controller 100 can detect that the small protrusion 164 is the rotation phase immediately after passing in front of the intake side cam position sensor 160 based on the switch.

In the internal combustion engine 10, the timing rotor 161 having the same shape is also attached to the exhaust camshaft 26. Therefore, the exhaust-side cam angle signal detected by the exhaust-side cam position sensor 170 also changes periodically in the same change pattern as the intake-side cam angle signal shown in FIG. 6. Therefore, the controller 100 can detect what rotation phase the exhaust camshaft 26 is in by recognizing the change pattern of the exhaust-side cam angle signal output from the exhaust-side cam position sensor 170.

Since the cam angle signal periodically changes in a fixed change pattern as described above, the controller 100 can detect the rotation direction of the intake camshaft 25 and the exhaust camshaft 26 by recognizing the change pattern.

The timing rotor 161 attached on the exhaust camshaft 26 is attached by deviating a phase with respect to the timing rotor 161 attached on the intake camshaft 25. Specifically, the timing rotor 161 attached on the exhaust camshaft 26 is attached by deviating a phase by 30° to an advance angle side with respect to the timing rotor 161 attached on the intake camshaft 25.

Figure 7:
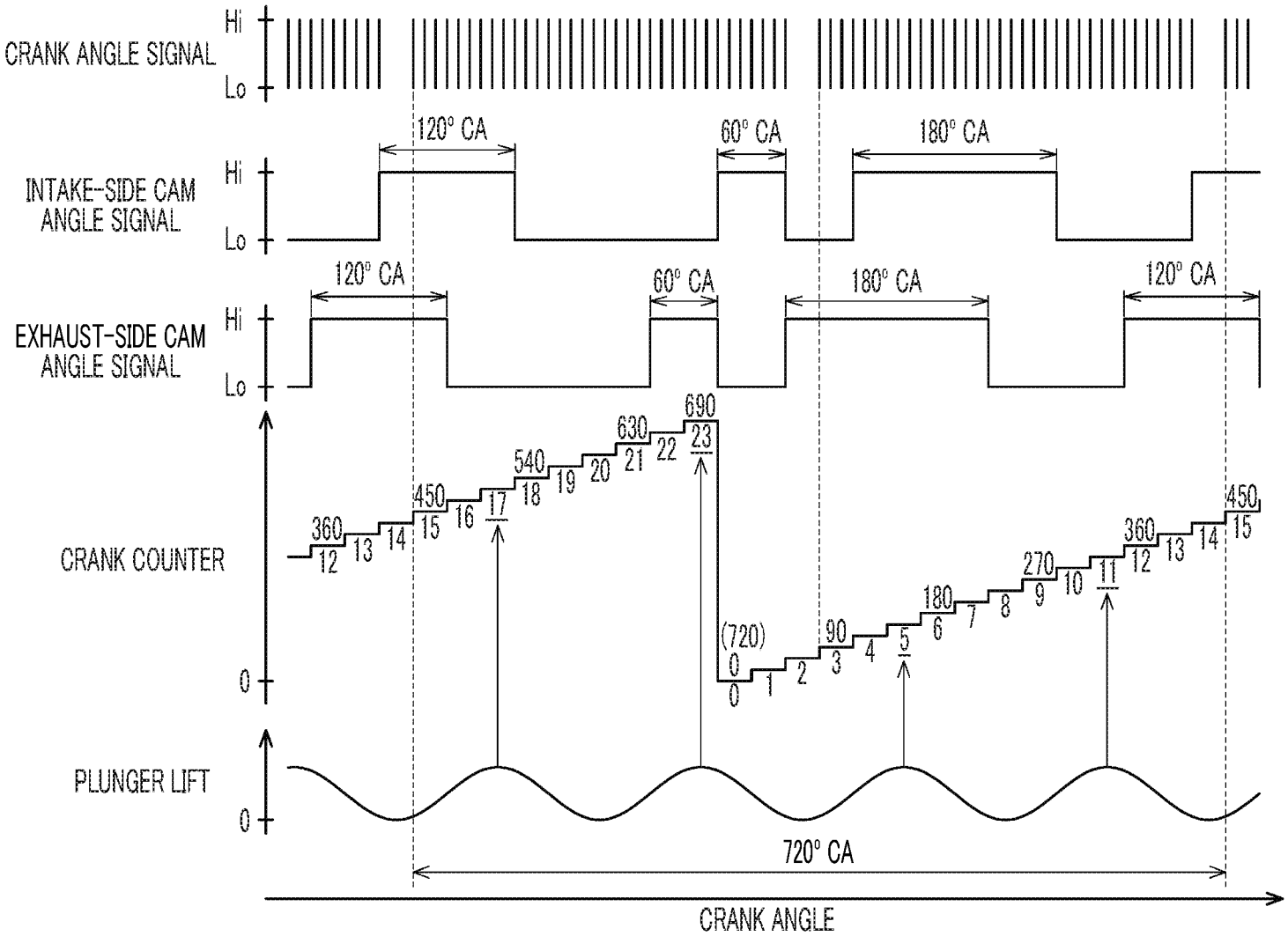
FIG. 7 is a timing chart showing a relationship between the crank angle signal, the cam angle signal, and a crank counter, and a relationship between the crank counter and a top dead center of a plunger.

As a result, as shown in FIG. 7, the change pattern of the intake-side cam angle signal changes with a delay of 60° C.A at the crank angle with respect to the change pattern of the exhaust-side cam angle signal.

FIG. 7 is a timing chart showing a relationship between the crank angle signal and the crank counter, and a relationship between the crank counter and the cam angle signal. In addition, the edges that change from the Hi signal to the Lo signal in the crank angle signal is solely shown in FIG. 7.

As described above, the crank counter calculation unit 103 of the controller 100 counts the edges when the crank angle signal output from the crank position sensor 150 changes from the Hi signal to the Lo signal with the engine operation, and calculates the crank counter. Further, the crank counter calculation unit 103 performs cylinder discrimination based on the crank angle signal, the intake-side cam angle signal, and the exhaust-side cam angle signal.

Specifically, as shown in FIG. 7, the crank counter calculation unit 103 counts the edges of the crank angle signal output every 10° C.A, and counts up the crank counter each time three edges are counted. That is, the crank counter calculation unit 103 counts up a crank counter value VCA which is the value of the crank counter every 30° C.A. The controller 100 recognizes the current crank angle based on the crank counter value VCA, and controls the timing of fuel injection and ignition for each cylinder.

Further, the crank counter is reset periodically every 720° C.A. That is, as shown in the center of FIG. 7, at the next count-up timing after counting up to "23" corresponding to 690° C.A, the crank counter value VCA is reset to "0", and the crank counter is again counted up every 30° C.A.

When the missing teeth portion 153 passes in front of the crank position sensor 150, the detected edge interval is 30° C.A. Therefore, when the interval between the edges is widened, the crank counter calculation unit 103 detects that the missing teeth portion 153 has passed in front of the crank position sensor 150 based on the interval. Since missing teeth detection is performed every 360° C.A, the missing teeth detection is performed twice during 720° C.A while the crank counter is counted up for one cycle.

Since the crankshaft 18, the intake camshaft 25, and the exhaust camshaft 26 are connected to each other via the timing chain 29, a change in the crank counter and a change in the cam angle signal have a fixed correlation.

That is, the intake camshaft 25 and the exhaust camshaft 26 rotate once while the crankshaft 18 rotates twice. Therefore, in a case where the crank counter value VCA is known, the rotation phases of the intake camshaft 25 and the exhaust camshaft 26 at that time can be estimated. In a case where the rotation phases of the intake camshaft 25 and the exhaust camshaft 26 are known, the crank counter value VCA can be estimated.

The crank counter calculation unit 103 decides the crank angle that becomes a starting point when the crank counter calculation unit 103 starts the calculation of the crank counter and also decides the crank counter value VCA using a relationship between the intake-side cam angle signal, the exhaust-side cam angle signal, and the crank counter value VCA, and a relationship between the missing teeth detection and the crank counter value VCA.

In addition, after the crank angle is identified and the crank counter value VCA to be a starting point is identified, the crank counter calculation unit 103 starts counting up from the identified crank counter value VCA as a starting point. That is, the crank counter is not decided and is not output while the crank angle is not identified and the crank counter value VCA as a starting point is not identified. After the crank counter value VCA to be a starting point is identified, counting up is started from the identified crank counter value VCA as a starting point, and the crank counter value VCA is output.

When a relative phase of the intake camshaft 25 with respect to the crankshaft 18 is changed by the intake-side variable valve timing mechanism 27, relative phases of the sensor plate 151 attached to the crankshaft 18 and the timing rotor 161 attached to the intake camshaft 25 are changed. Therefore, the controller 100 grasps the change amount in the relative phase according to a displacement angle which is the operation amount of the intake-side variable valve timing mechanism 27 by the valve timing control unit 106, and decides the crank counter value VCA to be a starting point considering an influence according to the change in the relative phase. The same applies to the change of the relative phase of the exhaust camshaft 26 by the exhaust-side variable valve timing mechanism 28.

In the internal combustion engine 10, as shown in FIG. 7, the crank angle when the intake cam angle signal switches from the Lo signal that continues over 180° C.A to the Hi signal that continues over 60° C.A is set to "0° C.A". Therefore, as shown by a broken line in FIG. 7, the missing teeth detection performed immediately after the intake cam angle signal is switched from the Hi signal to the Lo signal that continues over 60° C.A indicates that the crank angle is 90° C.A. On the other hand, the missing teeth detection performed immediately after the intake cam angle signal is switched from the Lo signal to the Hi signal that continues over 120° C.A indicates that the crank angle is 450° C.A. In addition, in FIG. 7, the crank counter value VCA is shown below a solid line indicating a change of the value of the crank counter, and the crank angle corresponding to the crank counter value VCA is shown above this solid line. FIG. 7 shows a state where the displacement angle in the intake-side variable valve timing mechanism 27 and the displacement angle in the exhaust-side variable valve timing mechanism 28 are both "0".

As described above, since the change in the cam angle signal and the crank angle have a correlation with each other, In some cases, the crank counter value VCA as a starting point can be quickly decided without waiting for the missing teeth detection by estimating the crank angle corresponding to the combination of the intake-side cam angle signal and the exhaust-side cam angle signal according to the pattern of the combination.

However, in the case of automatic restart from automatic stop by stop & start control, it is preferable to execute the in-cylinder fuel injection that can inject the fuel directly into the cylinder to quickly restart combustion. When the fuel is supplied into the cylinder by port injection, it takes more time for the fuel to reach the cylinder than when the fuel injection is performed by the in-cylinder fuel injection valve 15 or the fuel adheres to the intake port 13. Therefore, there is a possibility that startability may be deteriorated.

Accordingly, at the time of automatic restart from automatic stop by the stop & start control, the controller 100 executes the engine start by in-cylinder fuel injection. However, since the high pressure fuel pump 60 is not driven while the engine is stopped, the high pressure system fuel pressure PH at the time of automatic restart may drop to an insufficient level to execute the in-cylinder fuel injection. When the high pressure system fuel pressure PH is low, the engine cannot be properly started by the in-cylinder fuel injection. Therefore, when the high pressure system fuel pressure PH at the time of the automatic restart is low, the high pressure fuel pump 60 is driven by cranking by the starter motor 40, and the in-cylinder fuel injection is performed after waiting for the high pressure system fuel pressure PH to increase.

When an abnormality occurs in the high pressure-side fuel supply system 51 including the high pressure system fuel pressure sensor 185 and the high pressure fuel pump 60, the high pressure system fuel pressure PH detected by the high pressure system fuel pressure sensor 185 may not be sufficiently high even though the high pressure fuel pump 60 is driven. Therefore, the controller 100 calculates the number of pump driving times NP, which is the number of driving times of the high pressure fuel pump 60, using the crank counter value VCA, and determines whether or not to perform the in-cylinder fuel injection using the number of pump driving times NP. Therefore, as shown in FIG. 1, the controller 100 is provided with a number of driving times calculation unit 108 for calculating the number of pump driving times NP.

The number of driving times calculation unit 108 calculates the number of pump driving times NP using a relationship between the crank counter value VCA and the top dead center of the plunger 62 of the high pressure fuel pump 60. Additionally, in the following, the top dead center of the plunger 62 is referred to as a pump TDC.

As shown in FIG. 7, lift amount of the plunger 62 of the high pressure fuel pump 60 fluctuates periodically according to the change of the crank counter value VCA. This is because the pump cam 67 that drives the plunger 62 of the high pressure fuel pump 60 is attached to the intake camshaft 25. That is, in the internal combustion engine 10, the pump TDC can be linked to the crank counter value VCA, as indicated by the arrow in FIG. 7. In FIG. 7, the crank counter value VCA corresponding to the pump TDC is underlined.

The storage unit 102 of the controller 100 stores a map in which the pump TDC is associated with the crank counter value VCA. In addition, the number of driving times calculation unit 108 calculates the number of pump driving times NP with reference to the map based on the crank counter value VCA.

Figure 8:
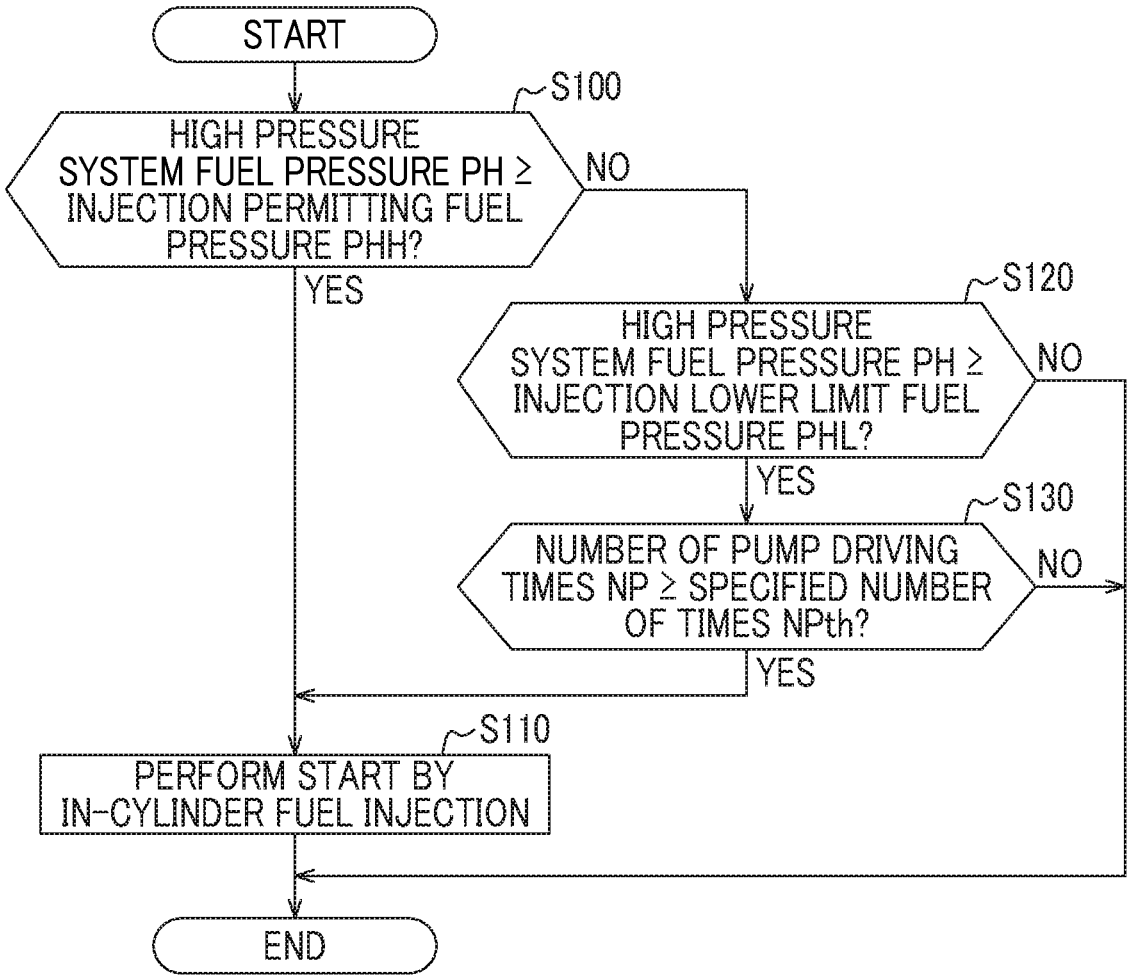
FIG. 8 is a flowchart showing a flow of a series of processing in a routine executed when whether or not to start an engine by an in-cylinder fuel injection is determined.

Hereinafter, the control at the time of restarting and the calculation of the number of pump driving times NP executed by the controller 100 will be described. First, with reference to FIG. 8, processing of determining whether or not to perform the start by the in-cylinder fuel injection at the time of restarting will be described. FIG. 8 is a flowchart showing a flow of processing in a routine executed by controller 100 at the time of restarting.

When the restart is performed, the controller 100 repeatedly executes the routine under the condition that the coolant temperature THW acquired by the acquisition unit 101 is equal to or more than a permitting coolant temperature. When the coolant temperature THW is low, it is difficult for the fuel to atomize, and there is a possibility that the engine start by the in-cylinder fuel injection fails. Therefore, even at the time at which the controller 100 is restarted, in a case where the coolant temperature THW is less than the permitting coolant temperature, the controller 100 does not execute the routine but performs the engine start by the port injection.

As shown in FIG. 8, when the routine is started, the controller 100 determines whether or not the high pressure system fuel pressure PH is equal to or more than the injection permitting fuel pressure PHH in processing of step S100. The injection permitting fuel pressure PHH is a threshold for determining that the high pressure system fuel pressure PH is high enough to start the internal combustion engine 10 by the in-cylinder fuel injection based on the fact that the high pressure system fuel pressure PH is equal to or more than the injection permitting fuel pressure PHH. Since the start by the in-cylinder fuel injection becomes more difficult as the temperature of the internal combustion engine 10 becomes lower, the injection permitting fuel pressure PHH is set to a value corresponding to the coolant temperature THW so as to become higher value as the coolant temperature THW becomes lower.

When processing of step S100 determines that the high pressure system fuel pressure PH is equal to or more than the injection permitting fuel pressure PHH (step S100: YES), the controller 100 causes the processing to proceed to step S110. Then, the controller 100 is started by the in-cylinder fuel injection in the processing of step S110.

Specifically, the fuel is injected from the in-cylinder fuel injection valve 15 by the injection control unit 104, and the ignition is performed by the ignition device 16 due to the ignition control unit 105, and the start by the in-cylinder fuel injection is performed. When the processing of step S110 is performed in this way, the controller 100 temporarily ends the series of processing.

On the other hand, when the processing of step S110 determines that the high pressure system fuel pressure PH is less than the injection permitting fuel pressure PHH (step S100: NO), the controller 100 causes the processing to proceed to step S120. In addition, the controller 100 determines whether or not high pressure system fuel pressure PH is equal to or more than an injection lower limit fuel pressure PHL in the processing of step S120. The injection lower limit fuel pressure PHL is a threshold for determining that the start by the in-cylinder fuel injection is not to be performed based on the fact that the high pressure system fuel pressure PH is less than the injection lower limit fuel pressure PHL. The injection lower limit fuel pressure PHL is less than the injection permitting fuel pressure PHH. Further, as described above, since the start by the in-cylinder fuel injection becomes more difficult as the temperature of the internal combustion engine 10 becomes lower, the injection lower limit fuel pressure PHL is also set to a value corresponding to the coolant temperature TI-1W so as to become higher value as the coolant temperature THW becomes lower as with the injection permitting fuel pressure PHH.

When the processing of step S120 determines that the high pressure system fuel pressure PH is less than the injection lower limit fuel pressure PHL (step S120: NO), the controller 100 temporarily ends the series of processing.

That is, in this case, the controller 100 does not execute the processing of step S110, and does not execute the start by the in-cylinder fuel injection.

On the other hand, when the processing of step S120 determines that the high pressure system fuel pressure PH is equal to or more than the injection lower limit fuel pressure PHL (step S120: YES), the controller 100 causes the processing to proceed to step S130. In addition, in the processing of step S130, the controller 100 determines whether or not the number of pump driving times NP calculated by the number of driving times calculation unit 108 is equal to or more than the specified number of times NPth. In addition, the specified number of times NPth is set based on the number of driving times of the high pressure fuel pump 60 needed to increase the high pressure system fuel pressure PH to a pressure at which the start by the in-cylinder fuel injection can be performed. That is, the specified number of times NPth is a threshold for determining whether or not the number of pump driving times NP has reached the number of driving times needed to increase the high pressure system fuel pressure PH to a pressure at which the start by the in-cylinder fuel injection can be performed.

When the processing of step S130 determines that the number of pump driving times NP is less than the specified number of times NPth (step S130: NO), the controller 100 temporarily ends the series of processing. That is, in this case, the controller 100 does not execute the processing of step S110, and does not execute the start by the in-cylinder fuel injection.

On the other hand, when the processing of step S130 determines that the number of pump driving times NP is equal to or more than the specified number of times NPth (step S130: YES), the controller 100 causes the processing to proceed to step S110 and performs the start by in-cylinder fuel injection. In addition, the controller 100 temporarily ends the series of processing.

The series of processing is repeatedly executed. Therefore, the high pressure system fuel pressure PH becomes equal to or more than the injection permitting fuel pressure PHH, or the number of pump driving times NP becomes equal to or more than the specified number of times NPth by driving the high pressure fuel pump 60 with the cranking performed along with the series of processing. As a result, the in-cylinder fuel injection may be performed while the series of processing is repeated.

However, the controller 100 stops repeating the execution of the routine even when the period during which the series of processing is repeated is equal to or longer than the predetermined period and the engine start by the in-cylinder fuel injection cannot be completed as well as when the engine start by the in-cylinder fuel injection is completed.

In addition, when the engine start by the in-cylinder fuel injection cannot be completed, the engine start by the port injection is performed. That is, when the condition for performing the engine start by the in-cylinder fuel injection is not satisfied even after the predetermined period has elapsed, the controller 100 switches to the engine start by the port injection. Further, the controller 100 switches to the engine start by the port injection in a case where, even though the condition for performing the engine start by the in-cylinder fuel injection is satisfied to execute the processing of step S110 and the engine start by the in-cylinder fuel injection is performed, the engine start has not been completed even after the predetermined period has elapsed.

Therefore, in the controller 100, even when the high pressure system fuel pressure PH is less than the injection permitting fuel pressure PHH, in a case where the high pressure system fuel pressure PH is equal to or more than the injection lower limit fuel pressure PHL, the start by the in-cylinder fuel injection is performed under the condition that the number of pump driving times NP is equal to or more than the specified number of times NPth. As a result, in the internal combustion engine 10, when the high pressure system fuel pressure PH is increased to the injection lower limit fuel pressure PHL or more, and the high pressure fuel pump 60 is driven to such an extent that the high pressure system fuel pressure PH may be high enough to allow the in-cylinder fuel injection, even when the high pressure system fuel pressure PH is not equal to more than the injection permitting fuel pressure PHH, the start by the in-cylinder fuel injection is performed.

Therefore, even when the high pressure system fuel pressure PH detected by the high pressure system fuel pressure sensor 185 is hardly increased for some reason, in a case where the start by the in-cylinder fuel injection is likely to succeed, the start by the in-cylinder fuel injection is attempted. Accordingly, when the high pressure system fuel pressure PH is less than the injection permitting fuel pressure PHH, the possibility that the start can be completed by the in-cylinder fuel injection increases as compared with the case where the start by the in-cylinder fuel injection is not uniformly performed.

Next, a method of calculating the number of pump driving times NP by the number of driving times calculation unit 108 will be described. The number of driving times calculation unit 108 repeats the processing of calculating the number of pump driving times NP from the start of the internal combustion engine 10 until completion of the start thereof, and counts the number of pump driving times NP until completion of the start. At the time at which the start is completed, the number of pump driving times NP is reset.

The number of driving times calculation unit 108 selectively uses three types of count processing, a first count processing, a second count processing, and a third count processing as the processing for calculating the number of pump driving times NP, according to the situation.

Figure 9:
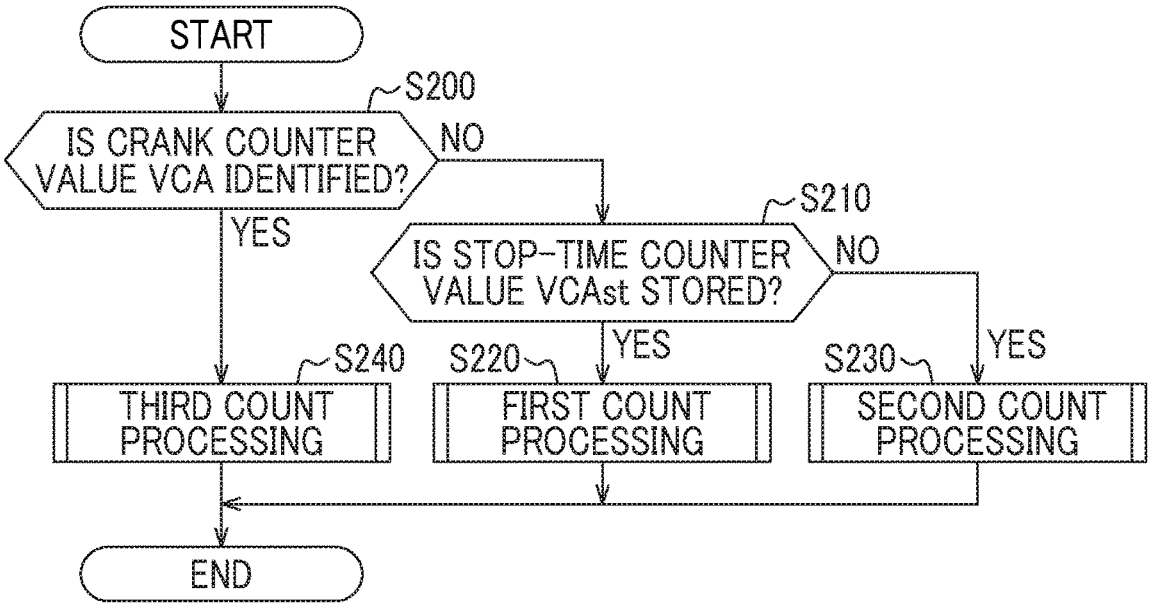
FIG. 9 is a flowchart showing a flow of a series of processing in a routine selecting count processing for counting the number of driving times of a high pressure fuel pump.

FIG. 9 is a flowchart showing a flow of a routine for selecting a calculation aspect of the number of pump driving times NP. The number of driving times calculation unit 108 of the controller 100 repeatedly executes the routine while the engine is started.

As shown in FIG. 9, when starting the routine, the number of driving times calculation unit 108 determines whether or not the crank angle is identified in the processing of step S200 and the crank counter value VCA is identified. When the processing of step S200 determines that the crank counter value VCA has not been identified yet (step S200: NO), the number of driving times calculation unit 108 causes the processing to proceed to step S210. In addition, the fact that the crank counter value VCA has not been identified yet means that the engine has just started, and the number of pump driving times NP has not been calculated.

The number of driving times calculation unit 108 determines whether or not the stop-time counter value VCAst is stored in the storage unit 102 in the processing of step S210. When the processing of step S210 determines that the stop-time counter value VCAst is stored (step S210: YES), the number of driving times calculation unit 108 causes the processing to proceed to step S220, and executes the first count processing. On the other hand, when the processing of step S210 determines that the stop-time counter value VCAst is not stored (step S210: NO), the number of driving times calculation unit 108 causes the processing to proceed to step S230, and executes the second count processing. The first count processing and the second count processing are count processing for calculating the number of pump driving times NP from a state where the crank counter value VCA is not identified. The contents of the first count processing and the second count processing will be described later.

When the processing of step S200 determines that the crank counter value VCA is identified (step S200: YES), the number of driving times calculation unit 108 causes the processing to proceed to step S240. In addition, the third count processing is executed in the processing of step S240. The third count processing is a count processing when the number of pump driving times NP is calculated in a state where the crank counter value VCA is already identified. The content of the third count processing will be described later.

When the count processing to be executed in this way is selected, the number of driving times calculation unit 108 temporarily ends the series of processing. Then, when the execution of the selected count processing ends, the series of processing is executed again. The series of processing is repeatedly executed until the engine start is completed.

Next, the contents of each count processing will be described. First, the first count processing executed when the crank counter value VCA is not identified (step S200: NO) and the stop-time counter value VCAst is stored (step S210: YES) will be described.

Figure 10:
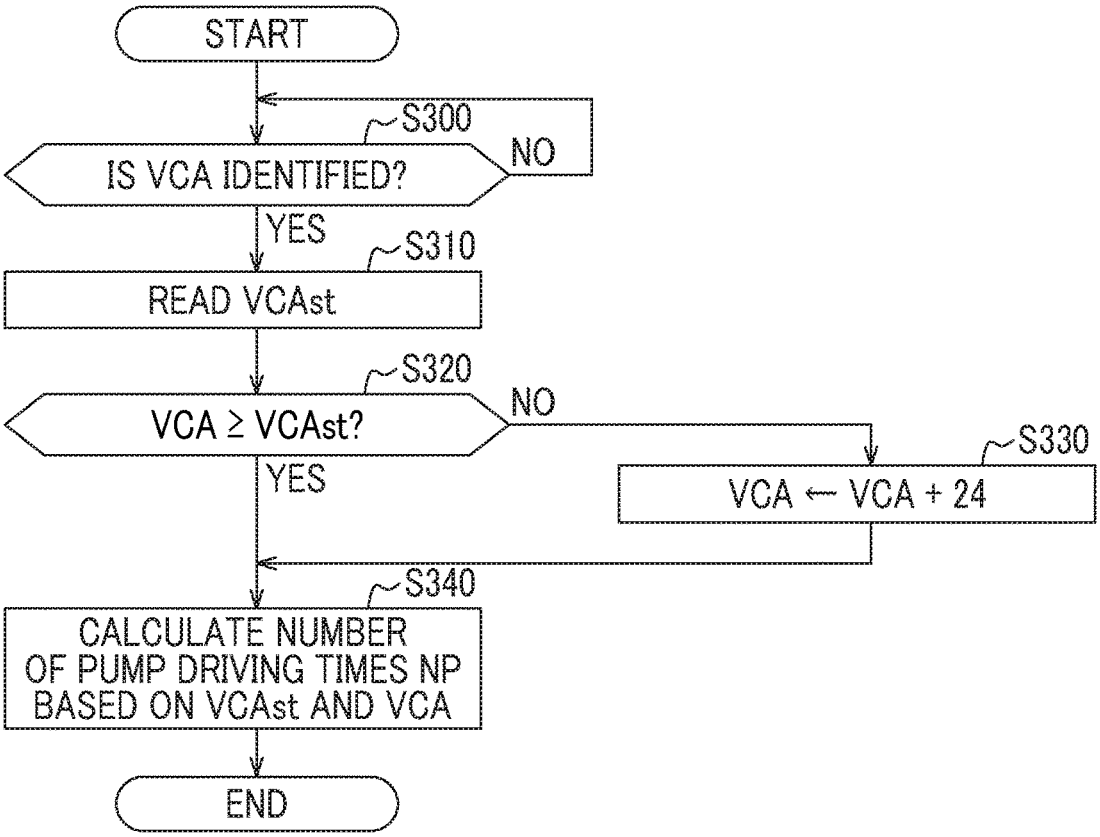
FIG. 10 is a flowchart showing a flow of processing in first count processing.

As shown in FIG. 10, when the first count processing is started, the number of driving times calculation unit 108 determines whether or not the crank angle is identified in the processing of step S300 and the crank counter value VCA is identified. When the processing of step S300 determines that the crank counter value VCA is not identified (step S300: NO), the number of driving times calculation unit 108 repeats the processing of step S300. On the other hand, when the processing of step S300 determines that the crank counter value VCA is identified (step S300: YES), the number of driving times calculation unit 108 causes the processing to proceed to step S310. In other words, the number of driving times calculation unit 108 causes the processing to proceed to step S310 after waiting for the crank angle to be identified and the crank counter value VCA to be identified.

In the processing of step S310, the number of driving times calculation unit 108 reads the stop-time counter value VCAst stored in the storage unit 102. Then, the processing proceeds to step S320. In the processing of step S320, the number of driving times calculation unit 108 determines whether or not the identified crank counter value VCA is equal to or more than the stop-time counter value VCAst.

When the processing of step S320 determines that the identified crank counter value VCA is equal to or more than the stop-time counter value VCAst (step S320: YES), the number of driving times calculation unit 108 causes the processing to proceed to step S340.

On the other hand, when the processing of step S320 determines that the identified crank counter value VCA is less than the stop-time counter value VCAst (step S320: NO), the number of driving times calculation unit 108 causes the processing to proceed to step S330. The number of driving times calculation unit 108 adds "24" to the identified crank counter value VCA in the processing of step S330, and the sum is newly set as the crank counter value VCA. That is, "24" is added to the crank counter value VCA to update the crank counter value VCA. Then, the number of driving times calculation unit 108 causes the processing to proceed to step S340.

In the processing of step S340, with reference to the map stored in the storage unit 102, the number of driving times calculation unit 108 calculates the number of pump driving times NP based on the stop-time counter value VCAst and the crank counter value VCA stored in the storage unit 102.

Figure 11:
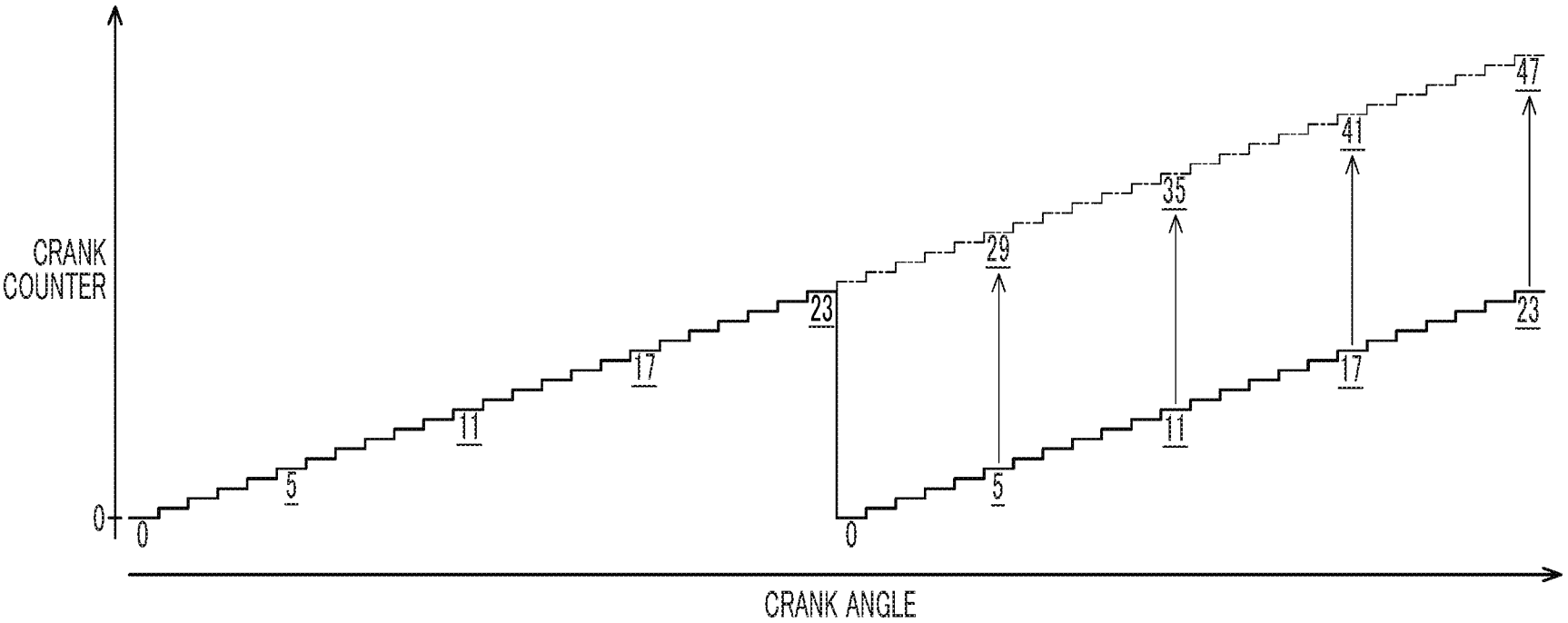
FIG. 11 is a diagram showing a relationship between information in a map stored in a storage unit and the crank counter.

The map stored in the storage unit 102 stores the crank counter value VCA which is underlined in FIG. 11. The underlined crank counter value VCA is the crank counter value VCA corresponding to the pump TDC as described above.

In the map, the crank counter values VCA "5", "11", "17", and "23" corresponding to the pump TDC in the range of 0° C.A to 720° C.A store "29", "35", "41", and "47" obtained by adding "24" corresponding to the number of the crank counter value in the range of 0° C.A to 720° C.A. That is, the crank counter value corresponding to the pump TDC among the crank counter values corresponding to the four rotations of the crankshaft 18 without being reset halfway is stored in the map.

In the processing of step S340, with reference to the map stored in the storage unit 102, the number of driving times calculation unit 108 searches the number of crank counter values corresponding to the pump TDC between the crank counter value VCA and the stop-time counter value VCAst based on the stop-time counter value VCAst and the crank counter value VCA. Then, the number calculated in this way is set as the number of pump driving times NP.

That is, in the first count processing, the number of pump driving times NP from the start of the engine to the identification of the crank counter value VCA is calculated by counting the number of crank counter values corresponding to the pump TDC existing between the stop-time counter value VCAst stored in the storage unit 102 and the identified crank counter value VCAst.

When the identified crank counter value VCA is less than the stop-time counter value VCAst (step S320: NO), "24" is added to update the crank counter value VCA (step S330). That is, as shown in FIG. 11, because the crank counter value is reset at 720° C.A.

Since the crank counter value is reset halfway, for example, the crank angle is identified and the identified crank counter value VCA is "8", whereas the identified crank counter value VCA may be less than the stop-time counter value VCAst, such as the stop-time counter value VCAst stored in the storage unit 102 being "20".

In such a case, the processing of step S320 determines that the identified crank counter value VCA found is less than the stop-time counter value VCAst (step S320: NO). Then, in the processing of step S330, "24" is added to the crank counter value VCA, and the crank counter value VCA is updated to "32". The map stores "23" and "29" existing between "20" which is the stop-time counter value VCAst and "32" which is the updated crank counter value VCA. Therefore, in this case, through the processing of step S340, by searching with reference to the map, it is calculated that there are two crank counter values corresponding to the pump TDC between the stop-time counter value VCAst and the identified crank counter value VCA. As a result, the number of pump driving times NP becomes "2".

Accordingly, in the first count processing, the crank angle changes across the phase in which the crank counter value VCA is reset to "0" until the crank angle is identified, and the number of pump driving times NP can be calculated even when the identified crank counter value VCA is less than the stop-time counter value VCAst.

Since the pump cam 67 for driving the high pressure fuel pump 60 is attached to the intake camshaft 25, when the relative phase of the intake camshaft 25 with respect to the crankshaft 18 is changed by the intake-side variable valve timing mechanism 27, a corresponding relationship between the crank counter value VCA and the pump TDC changes. Therefore, the number of driving times calculation unit 108 grasps the change amount in the relative phase according to a displacement angle which is the operation amount of the intake-side variable valve timing mechanism 27 by the valve timing control unit 106, and calculates the number of pump driving times NP in step S340 considering an influence according to the change in the relative phase. That is, the number of pump driving times NP in S340 is calculated by correcting the crank counter value VCA corresponding to the pump TDC stored in the map so as to correspond to the change in the relative phase.

For example, when the relative phase of the intake camshaft 25 is changed to the advance angle side, the correction is performed such that the crank counter value VCA stored in the map is reduced by an amount corresponding to the advance angle amount, and then the number of pump driving times NP is calculated.

When the number of pump driving times NP is calculated in this way, the number of driving times calculation unit 108 ends this series of processing. When the execution of the first counter processing is completed, the crank counter value VCA has already been identified. Therefore, when the counter processing is executed after the first count processing is completed, the third count processing is executed.

Next, the second count processing will be described with reference to FIG. 12. As described above, when the crank counter value VCA is not identified (step S200: NO) and the stop-time counter value VCAst is not stored (step S210: NO), the number of driving times calculation unit 108 repeatedly executes the second count processing shown in FIG. 12.

Figure 12:
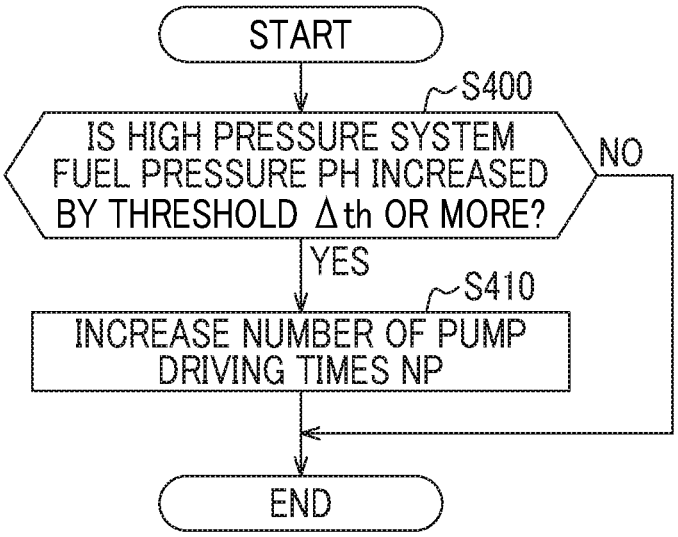
FIG. 12 is a flowchart showing a flow of processing in second count processing.

As shown in FIG. 12, when the second count processing is started, the number of driving times calculation unit 108 determines whether or not the high pressure system fuel pressure PH has increased by a threshold Δth or more in the processing of step S400.

Figure 13:
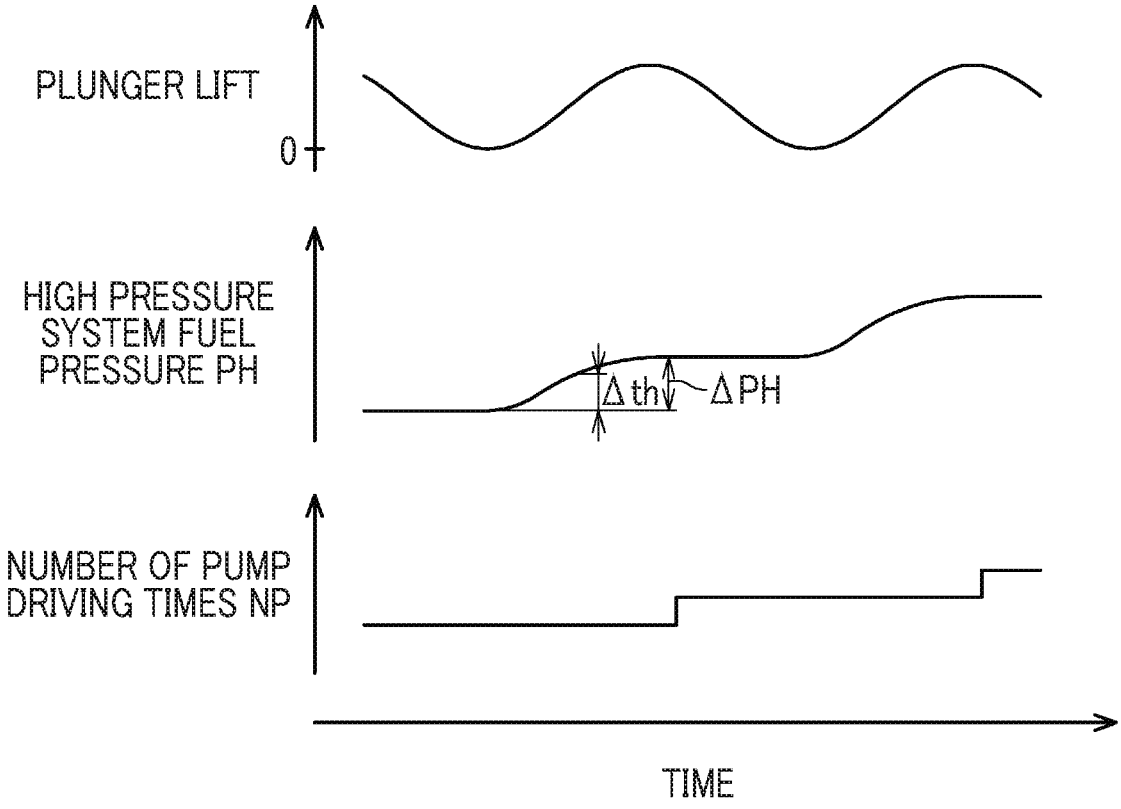
FIG. 13 is a timing chart showing changes in lift amount of the plunger, a high pressure system fuel pressure, and the number of pump driving times.

In the high pressure fuel pump 60, as shown in FIG. 13, the fuel is discharged when the plunger 62 rises, and the high pressure system fuel pressure PH increases. The number of driving times calculation unit 108 monitors the high pressure system fuel pressure PH acquired by the acquisition unit 101, and determines that the high pressure system fuel pressure PH has increased by the threshold value Δth or more when an increase width ΔPH is equal to or more than the threshold value Δth. In addition, the threshold value Δth is set to a size that can determine that the high pressure fuel pump 60 is normally driven and the fuel is discharged based on the fact that the increase width ΔPH is equal to or more than the threshold value Δth.

When the processing of step S400 determines that the high pressure system fuel pressure PH has increased by the threshold value Δth or more (step S400: YES), the number of driving times calculation unit 108 causes the processing to proceed to step S410. Then, in the processing of step S410, the number of driving times calculation unit 108 increases the number of pump driving times NP by one. Then, the number of driving times calculation unit 108 temporarily ends the routine.

On the other hand, when the processing of step S400 determines that the high pressure system fuel pressure PH has not increased by the threshold value Δth or more (step S400: NO), the number of driving times calculation unit 108 does not execute the processing of step S410, and temporarily ends the routine as it is. That is, at this time, the number of pump driving times NP is not increased and is maintained as the value is.

In this way, in the second count processing, as shown in FIG. 13, the number of pump driving times NP is calculated by increasing the number of pump driving times NP under the condition that the increase width ΔPH of the high pressure system fuel pressure PH is equal to or more than the threshold value Δth.

Next, the third count processing will be described with reference to FIG. 14. As described above, when the crank counter value VCA has already been identified (step S200: YES), the number of driving times calculation unit 108 repeatedly executes the third count processing shown in FIG. 14 each time the crank counter value VCA is updated.

Figure 14:
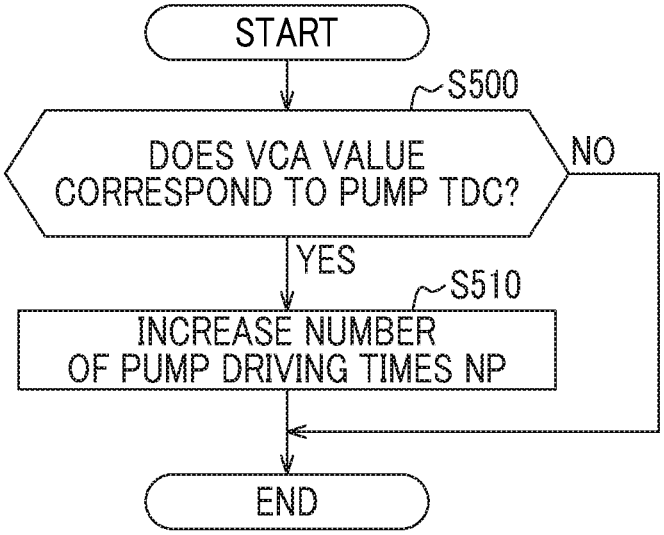
FIG. 14 is a flowchart showing a flow of processing in third count processing.

As shown in FIG. 14, when the third count processing is started, the number of driving times calculation unit 108 determines whether or not the crank counter value VCA is a value corresponding to the pump TDC in the processing of step S500 with reference to the map stored in the storage unit 102. That is, the number of driving times calculation unit 108 determines whether or not the crank counter value VCA is equal to any of values corresponding to the pump TDC stored in the map, and when the crank counter value VCA and the any of values are equal, the number of driving times calculation unit 108 determines that the crank counter value VCA is the value corresponding to the pump TDC.

When the processing of step S500 determines that the crank counter value VCA is the value corresponding to the pump TDC (step S500: YES), the number of driving times calculation unit 108 causes the processing to proceed to step S510. Then, in the processing of step S510, the number of driving times calculation unit 108 increases the number of pump driving times NP by one. Then, the number of driving times calculation unit 108 temporarily ends the routine.

On the other hand, when the processing of step S500 determines that the crank counter value VCA is not the value corresponding to the pump TDC (step S500: NO), the number of driving times calculation unit 108 does not execute the processing of step S510, and temporarily ends the routine as it is. That is, at this time, the number of pump driving times NP is not increased and is maintained as the value is.

In this way, in the third count processing, the number of pump driving times NP is calculated by increasing the number of pump driving times NP under the condition that the crank counter value VCA is the value corresponding to the pump TDC.

Therefore, in the internal combustion engine 10, the number of driving times calculation unit 108 calculates the number of pump driving times NP by switching the three count processing according to the situation. Then, the calculated number of pump driving times NP is used as one of the conditions for performing the engine start by the in-cylinder fuel injection.

The operation of the present embodiment will be described. In the controller 100, when the crank counter value VCA has not been identified (step S200: NO), the number of driving times calculation unit 108 calculates the number of crank counter values corresponding to the pump TDC between the crank counter value VCA and the stop-time counter value VCAst when the engine is started and the crank angle is identified. Then, the number of driving times calculation unit 108 sets the calculated number as the number of pump driving times NP from the start of the engine until the crank angle is identified.

If the crank counter value VCA when the stop-time counter value VCAst and the crank angle are identified is known, a change in the crank angle from a state where the internal combustion engine 10 is stopped until the crank angle is identified by driving the crankshaft 18 in accordance with the start of the engine is known. Therefore, as in the above configuration, the number of driving times of the high pressure fuel pump 60 during the period can be calculated by referring to the map that associates the pump TDC with the crank counter value VCA.

Further, in the controller 100, when the stop-time counter value VCAst is not stored in the storage unit 102 (step S210: NO), the number of pump driving times NP from the start of the engine until the crank angle is identified is calculated by increasing the number of pump driving times NP by one each time the high pressure system fuel pressure PH increases by the threshold value Δth or more.

Then, after the crank counter value VCA is identified (step S200: YES), the number of driving times calculation unit 108 calculates the number of pump driving times NP after the crank angle is identified with reference to the map based on the crank counter value VCA through the third count processing. In the third count processing, the number of pump driving times NP is updated by integrating the number of pump driving times NP from the start of the engine to the time when the crank angle is identified.

The effect of the present embodiment will be described. The number of pump driving times NP which is the number of driving times of the high pressure fuel pump 60 from the start of the engine until the crank angle is identified can be counted.

When the fuel is discharged from the high pressure fuel pump 60 by a reciprocating motion of the plunger 62, the high pressure system fuel pressure PH increases. Therefore, when the increase width ΔPH of the high pressure system fuel pressure PH becomes large enough to estimate the discharge of the fuel from the high pressure fuel pump 60, it can be estimated that the plunger has reciprocated once. Therefore, according to the above-described configuration in which the number of pump driving times NP is increased by one each time the high pressure system fuel pressure PH increases by the threshold value Δth or more, even when the stop-time counter value VCAst is not stored in the storage unit 102, the number of pump driving times NP from the start of the engine can be counted based on the high pressure system fuel pressure PH.

By referring to the map that associates the pump TDC with the crank counter value VCA, a timing when the plunger 62 reaches the top dead center can be grasped based on the crank counter value VCA. Therefore, the number of pump driving times NP after the crank angle is identified can be counted based on the crank counter value VCA by referring to the above described map.

Accordingly, according to the above-described configuration in which the number of pump driving times NP is increased based on the crank counter value VCA with reference to the map in the third count processing, the number of pump driving times NP from the start of engine startup can be calculated.

In the controller 100, the fuel injection of the in-cylinder fuel injection valve 15 is started when the calculated number of pump driving times NP is equal to or more than the specified number of times NPth and the high pressure system fuel pressure PH is high, and the start by the in-cylinder fuel injection is performed. Therefore, it is possible to suppress in-cylinder fuel injection from being performed in the state where the high pressure system fuel pressure PH is low.

The present embodiment can be implemented with the following modifications. The present embodiment and the following modifications can be implemented in combination with each other as long as there is no technical contradiction. In the above-described embodiment, the internal combustion engine 10 in which the pump cam 67 is attached to the intake camshaft 25 has been illustrated. However, the configuration for calculating the number of pump driving times NP as in the above embodiment is not limited to the internal combustion engine in which the pump cam 67 is driven by the intake camshaft. For example, the present disclosure can be applied to an internal combustion engine in which the pump cam 67 is attached to the exhaust camshaft 26. Further, the present embodiment can be similarly applied to an internal combustion engine in which the pump cam 67 rotates in conjunction with the rotation of the crankshaft 18. Therefore, the present embodiment can be applied to the internal combustion engine in which the pump cam 67 is attached to the crankshaft 18 or the internal combustion engine having the pump camshaft that rotates in conjunction with the crankshaft 18.

In the above-described embodiment, an example in which the number of pump driving times NP is used to determine whether or not to perform the engine start by the in-cylinder fuel injection has been described. However, the usage aspect of the number of pump driving times NP is not limited to such an aspect. For example, the high pressure system fuel pressure PH may be estimated using the number of pump driving times NP. In this case, as shown by a two-dot chain line in FIG. 1, the controller 100 is provided with a fuel pressure estimation unit 109. Then, the fuel pressure estimation unit 109 of the controller 100 estimates the high pressure system fuel pressure PH based on the number of pump driving times NP calculated by the number of driving times calculation unit 108. Specifically, the fuel pressure estimation unit 109 estimates that the higher the number of pump driving times NP, the higher the high pressure system fuel pressure PH.

The fact that the number of pump driving times NP is large means that the amount of the fuel delivered from the high pressure fuel pump 60 is large, and thus, the number of pump driving times NP is correlated with the high pressure system fuel pressure PH. Accordingly, as described above, the high pressure system fuel pressure PH can be estimated based on the calculated number of pump driving times NP. According to such a configuration, for example, even when the high pressure system fuel pressure sensor 185 that detects the high pressure system fuel pressure PH has an abnormality, a control based on an estimated high pressure system fuel pressure PH can be performed.

When the high pressure system fuel pressure PH is estimated based on the number of pump driving times NP as described above, the fuel injection from the in-cylinder fuel injection valve 15 can be started, and the start by the in-cylinder fuel injection can be performed when the estimated high pressure system fuel pressure PH is equal to or more than the specified pressure PHth. That is, in the processing of step S130, the controller 100 may determine whether or not the high pressure system fuel pressure PH estimated by the fuel pressure estimation unit 109 is equal to or more than the specified pressure PHth.

According to such a configuration, the fuel injection of the in-cylinder fuel injection valve 15 is started when it is estimated that the high pressure system fuel pressure PH estimated based on the calculated number of pump driving times NP is equal to or more than the specified pressure PHth and the high pressure system fuel pressure PH is high. Therefore, as with the above-described embodiment, it is possible to suppress in-cylinder fuel injection from being performed in the state where the high pressure system fuel pressure PH is low.

In addition, the usage aspect of the estimated high pressure system fuel pressure PH is not limited to the usage aspect described above. For example, an opening period of the in-cylinder fuel injection valve 15, that is, fuel injection time may be set according to a target injection amount based on the estimated high pressure system fuel pressure PH.

As a map referred to by the number of driving times calculation unit 108, a map storing information for four rotations of the crankshaft 18 is stored in the storage unit 102, and the map is used even when the crank counter value VCA is reset halfway, and thereby an example in which the number of pump driving times NP can be calculated is described. However, the method of calculating the number of pump driving times NP is not limited to such a method.

For example, even when a map for two rotations of the crankshaft 18 is stored in the storage unit 102, the number of pump driving times NP can be calculated. Specifically, when the identified crank counter value VCA is less than the stop-time counter value VCAst, in the first count processing, the number of crank counter values corresponding to the pump TDC separately between the stop-time counter value VCAst to "23" and between "0" to the identified crank counter value VCA may be searched. Also in this case, the number of pump driving times NP can be calculated by adding the searched numbers to the number of pump driving times NP.

An updating aspect of the number of pump driving times NP in the third count processing is not limited to the aspect described in the above embodiment. For example, each time the crank counter value VCA is updated a fixed number of times, it is also possible to calculate how many times the crank angle corresponding to the pump TDC has been passed with reference to the map, and to update the number of pump driving times NP by integrating the calculated number of times.

Although the example in which the internal combustion engine 10 includes the in-cylinder fuel injection valve 15 and the port injection valve 14 has been described, the internal combustion engine 10 may include solely the in-cylinder fuel injection valve 15, that is, solely the high pressure-side fuel supply system 51.

Although the example in which the internal combustion engine 10 includes the intake-side variable valve timing mechanism 27 and the exhaust-side variable valve timing mechanism 28 has been described, the configuration for calculating the number of pump driving times NP as described above can also be applied to internal combustion engines that does not have a variable valve timing mechanism.

Specifically, even when the internal combustion engine has a configuration that includes solely the intake-side variable valve timing mechanism 27, a configuration that includes solely the exhaust-side variable valve timing mechanism 28, and a configuration that does not include the variable valve timing mechanism, the configuration for calculating the number of pump driving times NP as described above can be applied.

An expression of the crank counter value VCA is not limited to one that counts up one by one such as "1", "2", "3", . . . For example, the expression may be counted up by 30 such as "0", "30", "60", . . . in accordance with the corresponding crank angle. Of course, the expression may not have to be counted up by 30 as in the crank angle. For example, the expression may be counted up by 5 such as "0", "5", "10", . . .

Although the example in which the crank counter value VCA is counted up every 30° C.A has been described, the method of counting up the crank counter value VCA is not limited to the aspect. For example, a configuration that counts up every 10° C.A may be adopted, or a configuration that counts up at intervals longer than 30° C.A may be adopted. That is, a configuration in which the crank counter is counted up each time three edges are counted, and the crank counter is counted up every 30° C.A is adopted in the above-described embodiment. However, the number of edges needed for counting up may be changed appropriately. For example, a configuration in which the crank counter is counted up each time one edge is counted, and the crank counter is counted up every 10° C.A can be also adopted.

What is claimed is:

1. A control system for an internal combustion engine including a high pressure fuel pump in which a volume of a fuel chamber is increased and is decreased and a fuel is pressurized by a reciprocating motion of a plunger due to an action of a pump cam that rotates in conjunction with a rotation of a crankshaft, and an in-cylinder fuel injection valve which injects the fuel into a cylinder, the control system comprising a controller configured to:

count a number of driving times of the high pressure fuel pump, which is the number of the reciprocating motions of the plunger based on a crank counter value that is counted up at every predetermined crank angle, store a map in which a top dead center of the plunger is associated with crank counter values, and store the crank counter value when the crankshaft is stopped as a stop-time counter value, referring to the map, calculate the number of the crank counter values corresponding to the top dead center of the plunger between the crank counter value when the crank angle is identified after starting the engine and the stop-time counter value, and set the calculated number as the number of driving times from the start of the engine until the crank angle is identified, and cause the in-cylinder fuel injection valve to start to inject the fuel when the number of driving times is equal to or more than a specified number of times.

2. The control system according to claim 1, wherein:

the controller is configured to acquire a high pressure system fuel pressure detected by a fuel pressure sensor that detects a high pressure system fuel pressure which is a pressure of the fuel supplied to the in-cylinder fuel injection valve; and the controller is configured to, before having stored the crank counter value when the crankshaft is stopped as the stop-time counter value, calculate the number of driving times from the start of the engine until the crank angle is identified by increasing the number of driving times by one each time the high pressure system fuel pressure increases by a threshold or more.

3. The control system according to claim 1, wherein the controller is configured to calculate the number of driving times of the high pressure fuel pump after the crank angle is identified with reference to the map based on the crank counter value, and update the number of driving times by integrating the calculated number of driving times into the number of driving times from the start of the engine until the crank angle is identified.

4. The control system according to claim 1, wherein the controller is configured to estimate a high pressure system fuel pressure which is a pressure of the fuel supplied to the in-cylinder fuel injection valve based on the calculated number of driving times.

5. An internal combustion engine comprising:

a high pressure fuel pump in which a volume of a fuel chamber is increased and is decreased and a fuel is pressurized by a reciprocating motion of a plunger due to an action of a pump cam that rotates in conjunction with a rotation of a crankshaft;

an in-cylinder fuel injection valve which injects the fuel into a cylinder; and a controller configured to count a number of driving times of the high pressure fuel pump, which is the number of the reciprocating motions of the plunger based on a crank counter value that is counted up at every predetermined crank angle, store a map in which a top dead center of the plunger is associated with crank counter values, and store the crank counter value when the crankshaft is stopped as a stop-time counter value, referring to the map, calculate the number of the crank counter values corresponding to the top dead center of the plunger between the crank counter value when the crank angle is identified after starting the engine and the stop-time counter value, and set the calculated number as the number of driving times from the start of the engine until the crank angle is identified, and cause the in-cylinder fuel injection valve to start to inject the fuel when the number of driving times is equal to or more than a specified number of times.

* * * * *